US012004557B2

(12) United States Patent
Holderman et al.

(10) Patent No.: US 12,004,557 B2
(45) Date of Patent: Jun. 11, 2024

(54) PACKAGING APPARATUS, SYSTEM, AND METHOD FOR FORMING FILLED CONES

(71) Applicant: MPI, LLC, Las Vegas, NV (US)

(72) Inventors: Mark W. Holderman, Spokane, WA (US); Gregory A. Russell, Spokane, WA (US)

( * ) Notice: Subject to any disclaimer, the term of this patent is extended or adjusted under 35 U.S.C. 154(b) by 418 days.

(21) Appl. No.: 17/507,239

(22) Filed: Oct. 21, 2021

(65) Prior Publication Data

US 2022/0175020 A1 Jun. 9, 2022

Related U.S. Application Data

(63) Continuation-in-part of application No. 17/113,429, filed on Dec. 7, 2020, now Pat. No. 11,794,438.

(51) Int. Cl.
*A24C 5/60* (2006.01)
*A24C 5/02* (2006.01)

(52) U.S. Cl.
CPC ..... *A24C 5/608* (2013.01); *A24C 5/02* (2013.01)

(58) Field of Classification Search
CPC ..... A24C 5/608; A24C 5/02; A24B 3/185
USPC ..... 141/82, 80, 73, 67, 12
See application file for complete search history.

(56) References Cited

U.S. PATENT DOCUMENTS

| | | | |
|---|---|---|---|
| 2,911,979 | A | 11/1959 | Bramhill |
| 2,925,347 | A | 2/1960 | Cummings |
| 2,982,074 | A | 5/1961 | Shiu |
| 3,028,029 | A | 4/1962 | Morse |
| 3,092,944 | A | 6/1963 | Wise |
| 3,591,041 | A | 7/1971 | DiGrande et al. |
| 3,618,642 | A | 11/1971 | Beaulieu |
| 4,002,005 | A | 1/1977 | Mueller et al. |
| 4,188,768 | A | 2/1980 | Getman |
| 4,608,809 | A | 9/1986 | Francis |
| 4,691,500 | A | 9/1987 | Danforth |
| 4,729,206 | A | 3/1988 | Francis |
| 4,782,644 | A | 11/1988 | Haarer |
| 5,676,306 | A | 10/1997 | Lankin et al. |
| 5,918,765 | A | 7/1999 | Blankenship |
| 6,044,886 | A | 4/2000 | Mueller |

(Continued)

FOREIGN PATENT DOCUMENTS

| | | |
|---|---|---|
| DE | 8015375 U1 | 12/1980 |
| GB | 810759 A | 3/1959 |

OTHER PUBLICATIONS

Machine Translation of DE8015375U1 to Oskar Graf company.

(Continued)

*Primary Examiner* — Timothy P. Kelly
*Assistant Examiner* — Christopher M Afful
(74) *Attorney, Agent, or Firm* — Aronberg Goldgehn Davis & Garmisa

(57) ABSTRACT

The present apparatus and system relate to a machine and components thereof adapted to fill packages and which may be utilized according to a method. The machine progresses a package via a conveyor through sub-stations, such as a cone trimmer, product conveyor, packing head, folding station, and injection station. The cone trimmer trims the package to a desired length, the product conveyor deposits product into the packing head, the packing head packs the product in the package, the folding station folds the package, and the injecting station injects the package.

6 Claims, 32 Drawing Sheets

(56) References Cited

U.S. PATENT DOCUMENTS

| | | | | |
|---|---|---|---|---|
| 7,032,359 | B1 | 4/2006 | Robert | |
| 7,918,334 | B2 | 4/2011 | Gaetano | |
| 9,125,435 | B1 | 9/2015 | Sinclair, Jr. | |
| 9,776,751 | B2 | 10/2017 | Lukes | |
| 10,856,574 | B2 | 12/2020 | Ghiotti | |
| 10,946,987 | B2 | 3/2021 | Ghiotti | |
| 11,148,835 | B2 | 10/2021 | Holderman et al. | |
| 2003/0185948 | A1 | 10/2003 | Garwood | |
| 2007/0000567 | A1 | 1/2007 | Marletto | |
| 2008/0145489 | A1 | 6/2008 | Green | |
| 2012/0230809 | A1 | 9/2012 | Bellante | |
| 2019/0328033 | A1* | 10/2019 | Holderman | A24C 5/06 |
| 2019/0329514 | A1* | 10/2019 | Holderman | B65B 39/12 |

OTHER PUBLICATIONS

Premium Vials, https://www.premiumvials.com/cones-coolbox-120-original-filling-machine-98mm-109mm/?gclid=Cj0KCQiAsvTxBRDKARIsAH4W_j_KMdv7et3w4Ow2EcsRWqUN_iPRYNFkH3npHZfx-v3f_ISGOINrUdgaAsoQEALw_wcB, 7 pages, USA.

Kynd Custom Packaging, https://kyndpackaging.com/pre-roll-packaging/, 9 pages, USA.

Custom Cones USA, https://customconesusa.com/pre-roll-machines/, 5 pages, USA.

Futurola, https://futurolausa.com/36-knockbox-accessories, 2 pages, USA.

Ganjarunner, https://ganjarunner.com/shop/medical-marijuana-products/pre-rolls/ganjagold-blue-tarantula/, 7 pages, USA.

* cited by examiner

PACKAGING APPARATUS, SYSTEM, AND METHOD FOR FORMING FILLED CONES

INCORPORATION BY REFERENCE

This application incorporates by reference in its entirety and for all purposes PCT patent application serial number PCT/US19/26711 filed on behalf of Mark W. Holderman and Gregory August Russell in the United States Patent Office on Apr. 10, 2019. This application incorporates by reference in its entirety and for all purposes U.S. patent application Ser. No. 17/113,429 filed on behalf of Mark W. Holderman and Gregory August Russell in the United States Patent Office on Dec. 7, 2020. This application incorporates by reference in its entirety and for all purposes PCT Patent Application Serial No. PCT/US21/55998 filed on behalf of Mark W. Holderman and Gregory August Russell in the United States Patent Office on Oct. 21, 2021.

BACKGROUND

Prior to the development of the present apparatus and system, paper cones were filled by hand. People would individually stuff product, such as leaves, into a single cone, and mechanically tamp down the leaves and twist the end closed. Alternately, numerous cones could be placed in what is essentially a honeycomb structure with holes that accommodate the cones. Crumbled leaves were then scattered over the holes containing the cones and vibrations or mechanical tamping were used to pack the leaves into the cones.

Each of the foregoing resulted in inaccurate and non-uniformly filled cones. The mechanical tamping often left the leaves too compacted. Sometimes the leaves at the bottom of the cone would be packed too much, while the leaves toward the top of the cone would remain too loose. The mechanical pressure had a tendency to rip the paper cones. Simply relying on vibrations to fill the cones would often result in leaves that were too loose.

These problems were often compounded by the type of particulate being packed. Specifically, for plant matter containing a relatively high oil content, the crumbled leaves tended to exhibit a sticky quality that resulted in clumping of the leaves together. The clumped leaves negatively affected the utility of the vibration method because the vibrations alone were not sufficient to break up the clumps. Similarly, the tamping method simply resulted in clumps that were more tightly packed together, exacerbating the problem. In both cases, the clumps tended to lodge in the narrow part of the cone creating air gaps or otherwise non-uniform packing of the plant material within the cone.

Non-uniform packing creates a number of problems. For example, it can affect the weight of the final product. When clumps get packed in with more loose plant matter, the density of the clumps can result in more than the desired amount of plant matter being packed into the cone. The clumps tend to burn at a different rate, disrupting the natural and correct burn rate of a correctly and uniformly packed cone. When clumps create air-gaps, the burn rate of the plant matter can be negatively affected because the lack of solid contact among the plant matter can result in an extinguishing of the plant matter. The density of the clumps can disrupt the flow of air through the plant matter, and act like a blockage in a straw.

Filling cones by hand, or with the honeycomb type packing device, also necessitates closing each of the cones by hand. Using those methods, a person was required to manually manipulate each cone and fold the open end to seal in the plant material and prevent it from falling out. Often, the cones would simply be closed by twisting the paper on top of the cone together to completely close and seal the top of the cone. That manual process is taxing on a person's hands and limits the number of cones that can be filled in a given amount of time. It also tends to result in non-uniform folded or twisted closures as people tend to have different techniques for folding or twisting, and dexterity becomes more limited as hands and fingers become more fatigued.

Further issues have been discovered when utilizing an automated system for filing cones. Automating the filling of cones requires more manipulation of the product, such as leaves, used to fill the cones. The product must be transported through the automated system, for example through a series of hoppers and conveyors. In doing so, the friction between the machine parts and the product (and simply among the product itself) generates heat that increases the base temperature of the product. In some instances (particularly in the case of product having a higher oil or moisture content), the warming of the product leads to the expression of oil, moisture, or resin from the product which can result in a tackiness that can further lead to clumping and residue buildup. Such adverse characteristics can, for example, block or bind automated components, interfere with the flow of product through the automated system, and lead to inaccurate filling of cones all of which lead to waste either in the form of lost product or lost productivity. In one example, clumping of dried leaves leads to bridging of product in funnel hoppers which bridging blocks the flow of product through the hopper and prevents the continued packaging of cones. In another example, residue builds up on the portions of the machine where the product frequently comes into contact with it, such as the packing head, the area surrounding the packing head, and the conveyor. Stickiness of the product can also cause problems when using suction to clean portions of the machine. The sticky product tends to bind to the inner workings of the vacuum and quickly clog the system and filter.

Traditionally, paper cones are made by hand or in a hybrid semi-automated process. Manufacturing tolerances respecting the overall length of the cone varies, resulting in a variable length of cone. This can lead to less than ideal tips of the cone during the filling and closing processes, particularly because extra cone material can fail to properly cover the distal end of a cone.

The automatic folding of the paper cone may be uneven if not carefully controlled. An uneven fold interferes with the infusion of a filled cone, the uniformity of lighting a filled cone, and the ability of a folded cone to maintain its fold. Therefore there is a need to ensure uniformity and greater plastic deformation of the distal ends of cones when folding the cones in an automated process.

SUMMARY

The present system provides an apparatus that may be utilize in conjunction with a method that accurately and uniformly fills paper cones with loose particles and closes the cones to prevent the particles from escaping the cones. While embodiments may generally be described herein as filling the cones with crumbled plant matter, such as crumbled dried leaves, it should be understood that any loose particles that could fit within the cone could be used as a filling for the cone without departing from the general scope of the apparatus and system. For simplicity, all such loose particles will simply be referred to herein as "leaves" or "particulate," but the use of such terms herein in no way limits the apparatus to only packaging organic plant matter. It should be understood that while "paper" is a common substance to be used for cones, that term is used generically herein for any relatively thin, flexible, flammable substrate and is not strictly limited to traditional paper. It should be understood that the term "cone" need not be a traditional cone with a point at one end, but may be of any generally cylindrical shape or shape having a greater length than width (or diameter, where the term "width" as it is used in describing the width of an object having a circular cross section is the diameter), though preferably the shape of a truncated traditional cone or frustum.

The present apparatus, system, and method overcome the shortcomings of the previously described manual and automatic filling methods by ensuring that the leaves are uniformly and consistently packed into the cones. The process is automated, allowing for consistent packaging and uniformity in the final product. It expedites the overall process of packing the cones. The present apparatus, system, and methods include a number of sub-components that individually perform packing functions. The sub-components each individually overcome different problems that occur when manually packaging leaves in cones.

A general system for automatically filling cones is described in United States PCT patent application serial number PCT/US19/26711, and U.S. patent application Ser. No. 17/113,429 each of which, as noted, is incorporated herein entirely and for all purposes. The present disclosure improves upon those systems through the implementation of alternative folding fingers used to fold the distal end of the cone in conjunction with the folding tip. The present disclosure also relates to improvements to the packing head, and fluid injection of filled cones as well as the addition of a cone trimmer to facilitate the formation of more uniform folded packages.

For example, the folding fingers may be comprised of a pair of co-planar fingers that, through the actuation of an actuator, are separated and brought together along a folding edge in a scissor-type action. At least one of the folding fingers includes a recess along at least a portion of the length of a blade (such as the front half, with the tip of the blade being the front, or the middle third), and both may include a semicircular indent in each blade as well. The indents are aligned so that when the blades come together, the indents form a shape which, in one embodiment is approximately the same size as the exterior cross-section of an axial pin of a folding tip. The scissor motion allows a single actuator to move both fingers simultaneously, and thereby ensure that the fingers reliably contact a cone to be folded in the same manner every time.

The packing head is generally a hollow chamber into which leaves are deposited and then funneled through an outlet and into a paper cone. To limit the expression of oil, moisture, or residue from leaves, the packing head body is chilled during the packing process, which in turn chills the leaves. Because leaves tend to be light, a packing rod assists with uniformly packing the cones with leaves. The packing rod may apply air bursts into the leaves being packed to facilitate packing within the cone. The air pressure tends to eject leaves out of the cone, and may eject them out of the packing head which is undesirable. To limit the backsplash of leaves, prevent tearing of the cone, and control the applied pressure, the packing chamber may be provided with one or more gates that close off the interior of the chamber, essentially closing the inlet where leaves are deposited. An exhaust chimney is connected to the interior of the packing chamber, which provides a pathway for excess pressurized gas to escape the chamber. By extending the chimney (in one embodiment approximately 10-20 inches from the packing chamber), leaves are prevented from escaping the chamber. Thus, in one embodiment, in operation, leaves are deposited into the chamber through an inlet and fall into the chilled packing chamber, where two gates close the inlet. The packing rod is moved to allow leaves to exit the packing chamber and fall into a paper cone. After or while the leaves are being deposited, the packing rod applies air bursts into the leaves in the cone. Some of the leaves may splash back into the chamber, and even into the chimney, but are prevented from fully escaping the chamber due to the chimney length. The leaves then fall back into the chamber and out the outlet to be deposited into the cone. The packing rod may be inserted into the outlet to substantially or completely block the outlet. A first gate is opened and a vacuum is applied to the chamber to clear out residual leaves. The second gate is opened and leaves are again deposited into the chamber to restart the process.

The fluid injecting station injects a fluid, such as an oil, into the leaf-filled cone. One problem that can occur is cavitation of the fluid, particularly when the flow of a fluid is repeatedly advanced and reversed in a flow path. The present system prevents cavitation and prevents air bubbles in the injecting fluid by controlling the fluid flow in the flow paths. The system includes a fluid reservoir and a positive pressure flow circuit that draws fluid from bottom of the reservoir and pumps the fluid into a hollow injector needle that is positioned within a needle cavity. The needle cavity is further connected to a negative pressure flow circuit that draws fluid out of the needle, into the needle cavity, and through the negative pressure flow circuit to deposit the fluid into the top of the reservoir. That structure and the associated directional flow paths ensure that fluid in each flow path is controlled to flow in a single direction in each flow path, while allowing the system to both eject fluid from the needle and draw fluid back up into the needle, all while preventing cavitation of the fluid and, more particularly, preventing or substantially limiting the injection of fluid having air bubbles into a filled paper cone.

The cone trimmer, which may be positioned between the cone carousel and the packing head, facilitates the formation of more uniform cones. In one embodiment, the cone trimmer includes a conveyor having a plurality of holes that each hold a single cone. The conveyor moves the cones into position above a cone lifter, which may be a plate attached to an actuator that raises and lowers the plate. A trimming head is positioned above the conveyor. The trimming head is adapted to trim the distal end of each cone. In one embodiment, the trimming head is scissor blades, and in another it is a blade that is drawn through the cone. The trimming head is attached to one or more actuators that position the trimming head with respect to the cone, for example by raising and lowering the trimming head with respect to the cone. In one embodiment, an encoder is connected to the actuator and to a control system. The control system, such as a general purpose computer, includes stored values, such as position values, corresponding to various sizes of cones. The stored values may correspond to encoder positions such that the control system actuates the actuator (for example a servo) to move the encoder to a preset position which in turn moves the trimming head to a known location with respect to the position of a cone. The cone lifter lifts the cone a set distance (a value that may also be stored in the control system) and thus the distance from the tip of the cone to the trimmer head is known, and the trimmer head can be actuated to trim the cone at that known distance thereby forming a cone of a known length. The encoder position can be adjusted for different sized cones, and therefore each cone can be trimmed to the same length for a respective sized cone. Trimming each cone ensures that, for a given general sized cone (e.g. a 0.75 g cone, 1.0 g cone, 1.15 g cone, etc.), the same length of the distal end of each respective cone is folded at the folding station (e.g. 10 mm of a 1.0 g. cone, 8 mm of a 0.75 g cone, etc.). It also allows a single packing system to adapt and pack a variety of different sized cones on the fly.

In one embodiment, a vacuum filtration system is employed. In one embodiment, when the cone is being folded, a folding tip is inserted into the distal end of a filled cone. The paper of the distal end is compressed against a pin of folding tip while air is injected into the filled cavity of the cone, and the distal end is vacuumed against an interior portion of the folding tip. The simultaneous application of air pressure and vacuum can lead to leaves being sucked into the vacuum, which can clog the system. The vacuum filtration system routs the vacuumed air (and particulate) into a camber containing a fluid, such as water. The vacuumed air is forced into the chamber and into the fluid, which then traps the particulate. Periodically, an actuator actuates to open a valve, such as a plunger, at the base of the fluid containing chamber. The fluid flows out of the chamber taking the particulate with it, the valve is closed, and the chamber refilled with fluid. The waste fluid may then be transferred to a further filtration system of a type known in the art which can be used to filter and reclaim the particulate from the fluid.

A folder sub-component having an air assist may be utilized to complete the packaging of the cone. The folder sub-component properly orients the cone. Folding fingers may precisely bend a portion of the cone and a folding tip compresses the bent portion of the cone to close it. Alternatively, an iris folding system may be utilized in place of the folding fingers to close on the distal portion of the cone and compress it against the folding tip. The folding tip may have an outer circumference that is configured to surround the distal end of a cone, particularly the distal rim of the distal end of a cone. It may also include a central portion, such as an axial pin. In some embodiments, the folding tip is adapted to apply one or more of vacuum pressure and positive air pressure to the cone. For example, suction may be applied by the folding tip circumferentially to the distal end of the cone, and air pressure may be injected into the interior of the cone through an axial pin of the folding tip. The folding fingers or iris release and the folding tip drives down onto the distal end of the paper cone to fold the distal rim and at least a portion of the distal end onto itself and into the interior cavity of the cone, thereby folding the distal end of the cone. The folded portion at least substantially (and may completely in some embodiments) cover the particulate within the cone. The use of the application of vacuum and air pressure increases the stiffness of the paper cone just prior to the folding tip folding the distal end of the cone. That increases the uniformity of the fold which enhances the plastic deformation of the distal end leading to a more reliable fold.

DETAILED DESCRIPTION OF EMBODIMENTS

Figure 1:
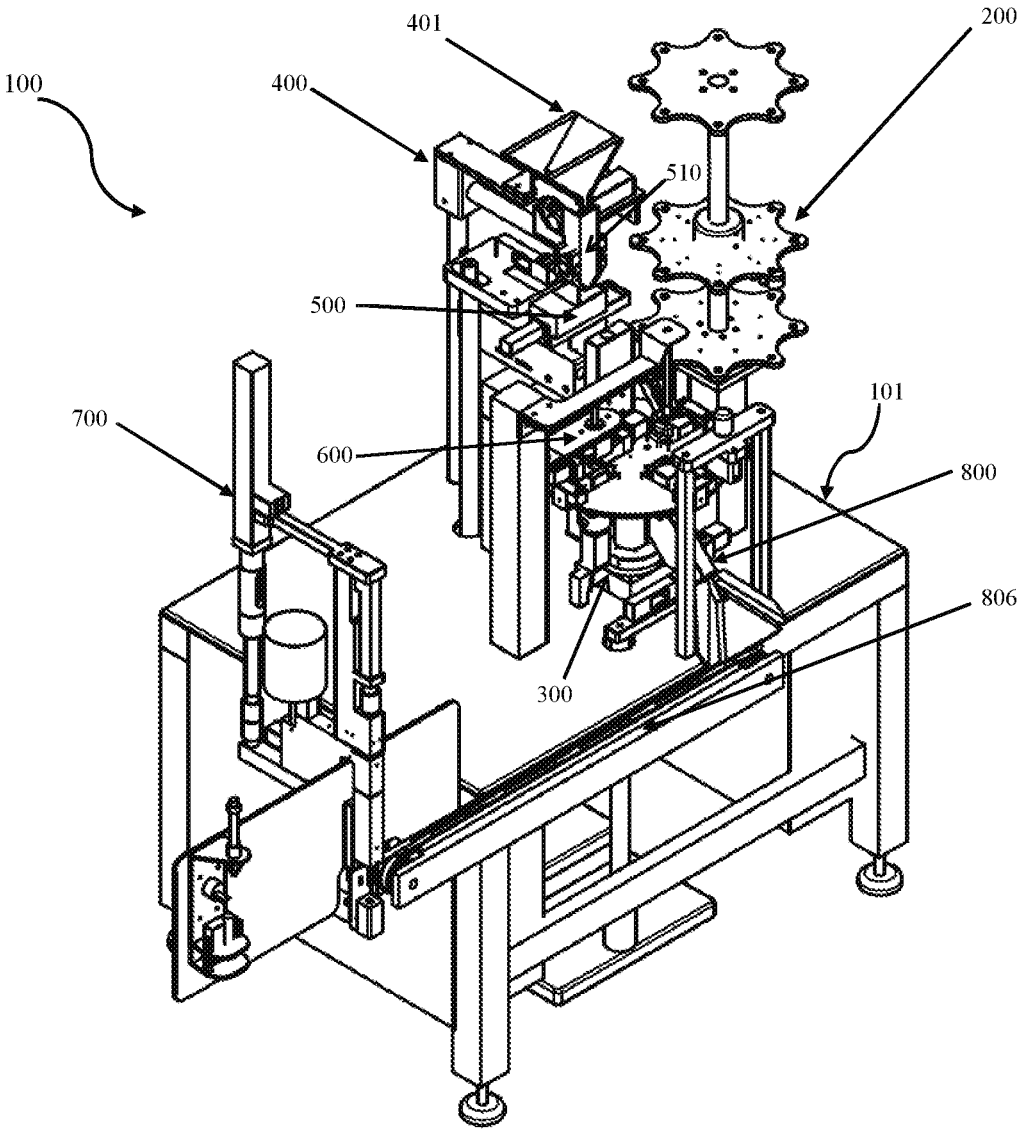
FIG. 1 is a perspective view of an embodiment of the apparatus and system generally depicting the relationship between various sub-systems of the apparatus.

Throughout the specification, wherever practicable, like structures will be identified by like reference numbers. In some figures, components, such as additional electrical connections and tubing (such as vacuum tubing and pneumatic tubing) have been omitted for clarity in the drawings. Additionally, in some figures repetitive structures, such as multiple actuators have been omitted. In such cases exemplary components are provided for explanatory purposes and it should be understood that other similar devices in the drawings may be provided with similar components. Unless expressly stated otherwise, the term "or" means "either or both" such that "A or B" includes A alone, B alone, and both A and B together.

FIG. 1 generally depicts an embodiment of a packaging assembly 100. Embodiments may include a carousel 200, a cone conveyor 300, a hopper assembly 400, a leaf conveyor (not shown), a grinder hopper 401, a packing station 500, a weigh station 510, a folder station 600, and a quality control station 800. Additionally, the packaging assembly may include a conveyor 806, and an injector station 700 (which may be integrated with the folder station or be a separate subassembly). The packaging assembly may also be provided with a cone trimming station (not shown) and a vacuum clean out (not shown). The various subassemblies may be mounted to a table 101.

The packaging assembly 100 is also equipped with a number of actuators. The actuators move the various components of the assembly into their proper positions. In one embodiment, the actuators are generally pneumatic actuators and electric motors, though it should be appreciated by one of ordinary skill in the art that any actuator could be used. By way of non-limiting example, continuous speed motors, variable speed motors, servo motors, hydraulics, or magnetic actuators could be used. By way of further example, an actuator could be in the form of a simple valve or switch that the control system operates to permit a hydraulic or pneumatic fluid to flow through the system and provide the force required by the system. A vacuum pump and vacuum tubing may also be utilized to control airflow in the system.

Figure 22:
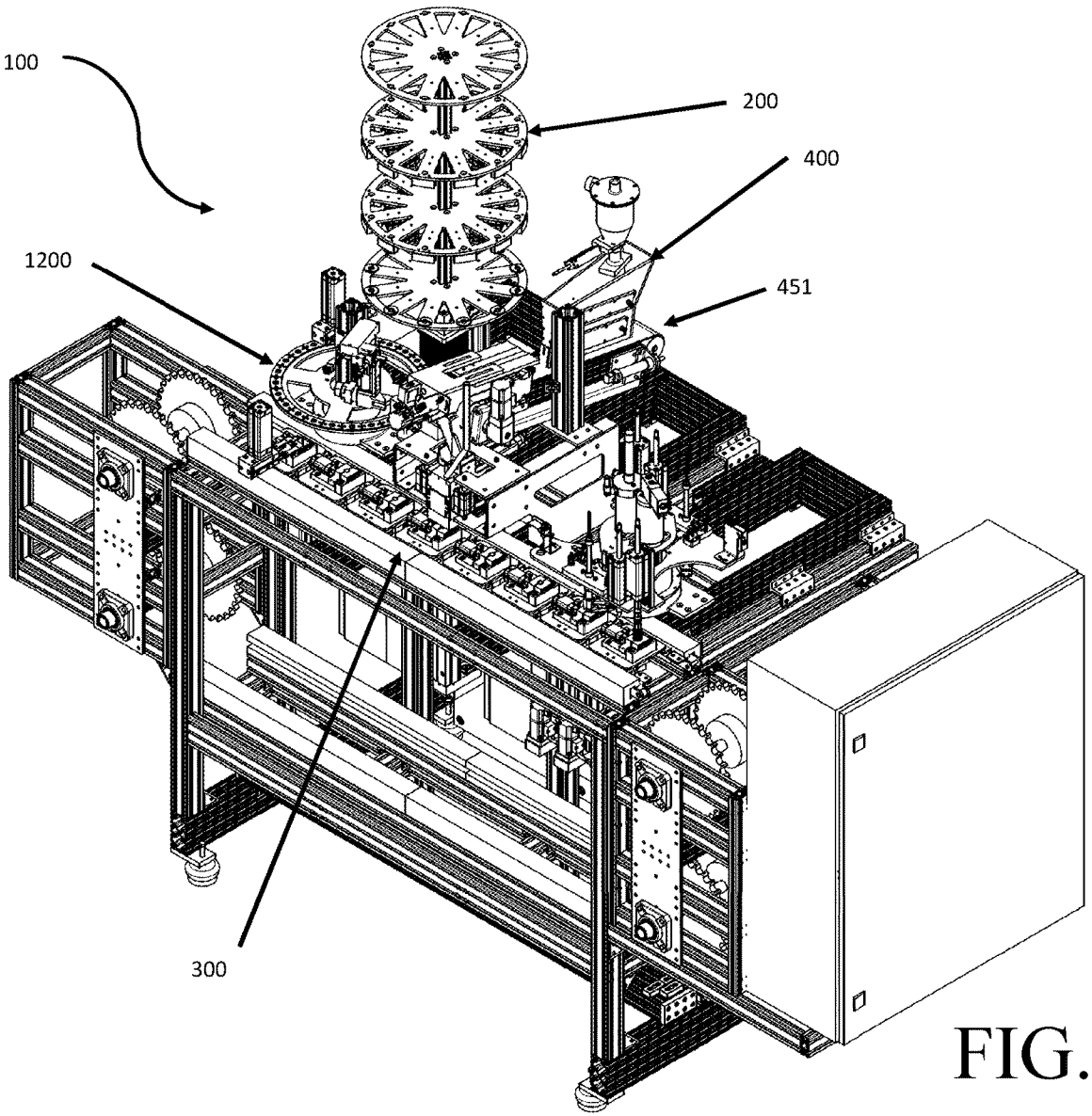
FIG. 22 is a perspective view of an alternate embodiment of the apparatus and system generally depicting the relationship between various sub-systems of the apparatus.

FIG. 22 is a general view of an alternate embodiment of the present apparatus and system depicting the sub-systems in a linear arrangement rather than a circular arrangement as in FIG. 1. FIG. 22 generally depicts an embodiment of a packaging assembly 100. It includes a carousel 200, a cone conveyor 300 that moves dies linearly through the system. It also includes a hopper assembly 400, a leaf conveyor 451, and a packing station and a folder station that are downstream from a cone trimming station 1200.

An electrical control system may be used to monitor and control the operation of the system and packaging assembly. The electrical control system may include dedicated circuits, programmable computer hardware, firmware, software, controllers, or a combination thereof. The control system coordinates the operation of the apparatus and system and particularly coordinates the actuators and the vacuum and pneumatics as well as utilizing sensor data, preset parameters stored in the control system, or a combination thereof. While it generally is advantageous to utilize a control system of a self-contained, locally oriented computer (with accompanying input and output devices such as a display, keyboard, mouse, touch screen, voice command control, etc.) to reduce latency in the feedback and command loop between the sensors, computer, and actuators, it is contemplated that parts of the control system could be organized in a distributed manner, with sub-control systems operating portions of the packaging system while networked with a main computer controller, or even that portions of the control system could be located off-site and connected over the internet.

In one embodiment, a computer monitors the sensors of the packaging assembly, and coordinates the operation of the actuators of the packaging assembly. Simultaneously, the computer records data respecting the operation of the packaging assembly. For example, the computer records the time each actuator is activated. The computer system may further compile the number of operations of each actuator to determine whether a completed product should have been created. For example, the computer identifies that the actuators of the carousel were activated, followed by the activation of the de-nesting fingers. A feedback sensor on the de-nesting fingers informs the computer that a cone was successfully withdrawn from the carousel and the computer logs that data. The computer then records activation of the cone conveyor and the activation of a weigh station sensor and weigh station actuator (indicating that product has been fed to the cone). The computer system logs the activation of the packing rod actuator followed by the activation of folding finger actuators (indicating that the filled cone has been completed), and the computer then logs the die actuator (releasing the filled cone) followed by sensor feedback from quality control sensors (such as recording the weight of the cone, an image of the cone, or a simple check that the cone is present). The computer then records whether the reject actuator was activated to determine whether the cone was accepted or rejected. The computer records the subsequent activation of the actuators of the fluid injecting station, including the operation of the fluid pumps to record whether the cone was filled with a fluid core, and how much fluid was deposited in the cone. Subsequent quality control data (and acceptance/rejection data) as described previously may be recorded. In some embodiments, the fluid filling occurs prior to any quality control. By coordinating the recording of the data pertaining to the actuators and sensors, the computer system is able to track individual cones as they progress through the packaging system.

The computer control system may also be connected to a cooling or refrigeration unit. One example of a suitable cooling unit is an aluminum block containing or affixed to a reservoir. A number of thermoelectric chips may be affixed to the aluminum block, such that, when energized, the TECs cool the block thereby cooling any refrigerant fluid in the reservoir within the block. A sensor may monitor the temperature of the coolant and provide feedback to the computer which in turn controls the temperature of the TECs and by extension the coolant. Other conventional refrigeration units will be apparent to those of ordinary skill in the art.

The refrigeration unit is connected to certain subcomponents of the assembly where it is desirable to maintain a consistent, cool temperature. These subcomponents are areas where the movement of the assembly or the product (leaves) through the assembly tends to create heat that warms the product.

In general, the packaging assembly is constructed of a number of different stations. The stations perform particular tasks which together assemble a filled cone. The packaging assembly shown in FIG. 1 is configured in a circular arrangement, such that the cones move through the system in a counterclockwise manner. However, it is contemplated that the cone conveyor could be arranged linearly with the stations arranged along it such as is shown in FIG. 22. In the embodiment of FIG. 1 cones from the carousel 200, are deposited to a cone conveyor 300, which moves the cone to a packing station 500, then to a folder station 600 followed by a quality control station 800. The cones may then proceed to an injector station 700.

Figure 12:
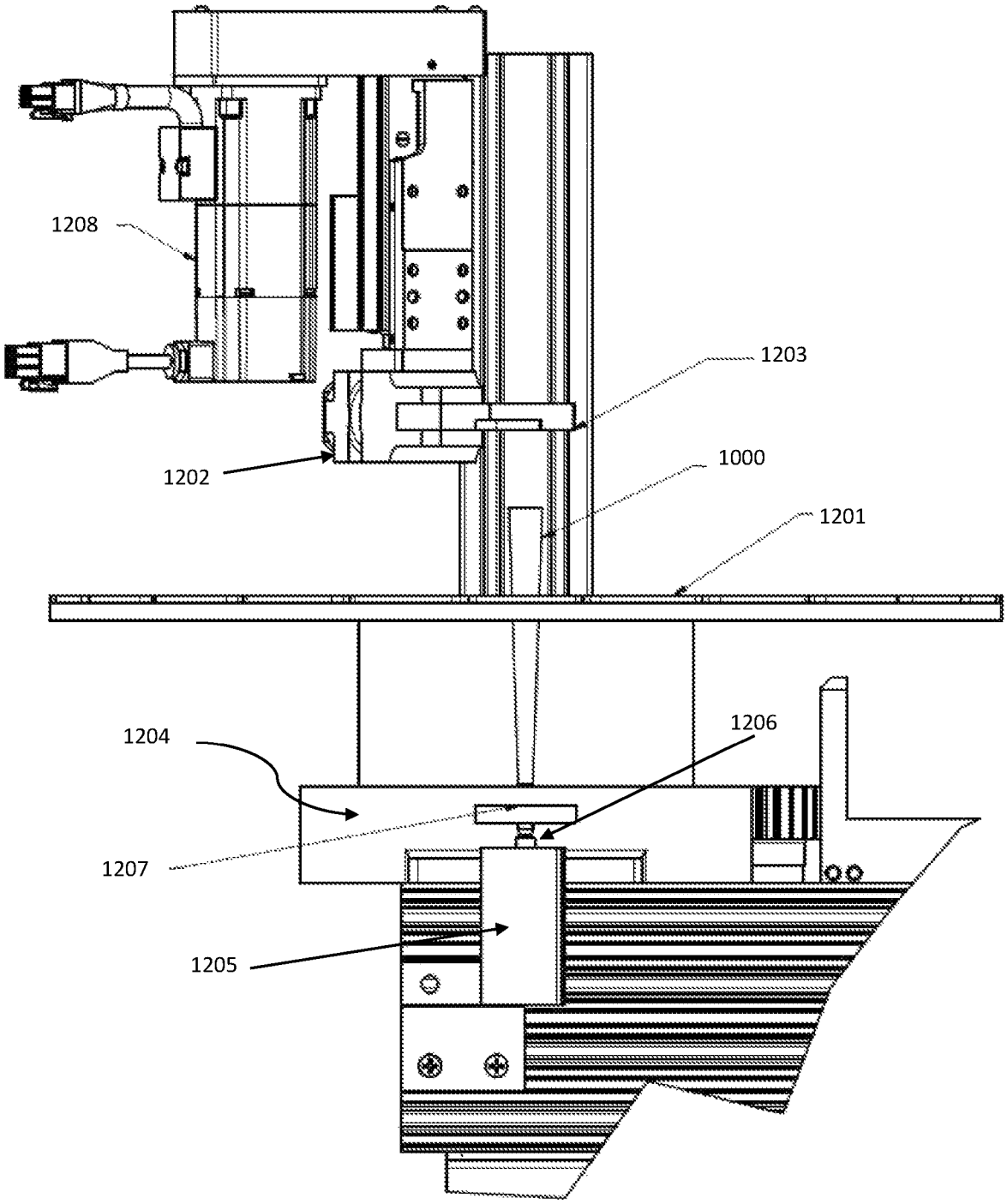
FIG. 12 is a side view of a cone trimmer station with the trimming head in a raised position and the cone lifter in the retracted position.
Figure 13:
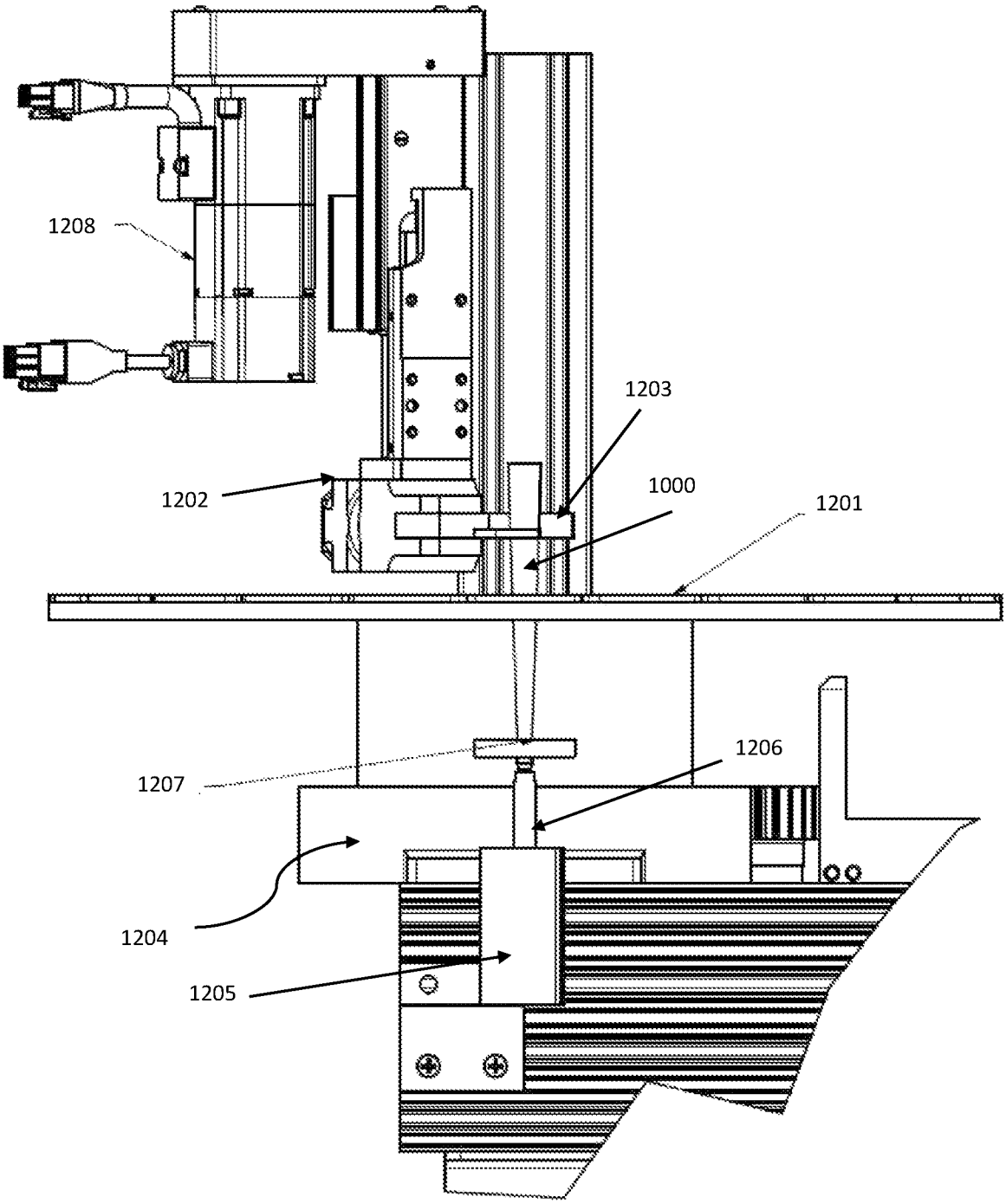
FIG. 13 is a side view of a cone trimmer station with the trimmer head in a lowered, trimming position, and the cone lifter in a raised, lifting position.
Figure 14:
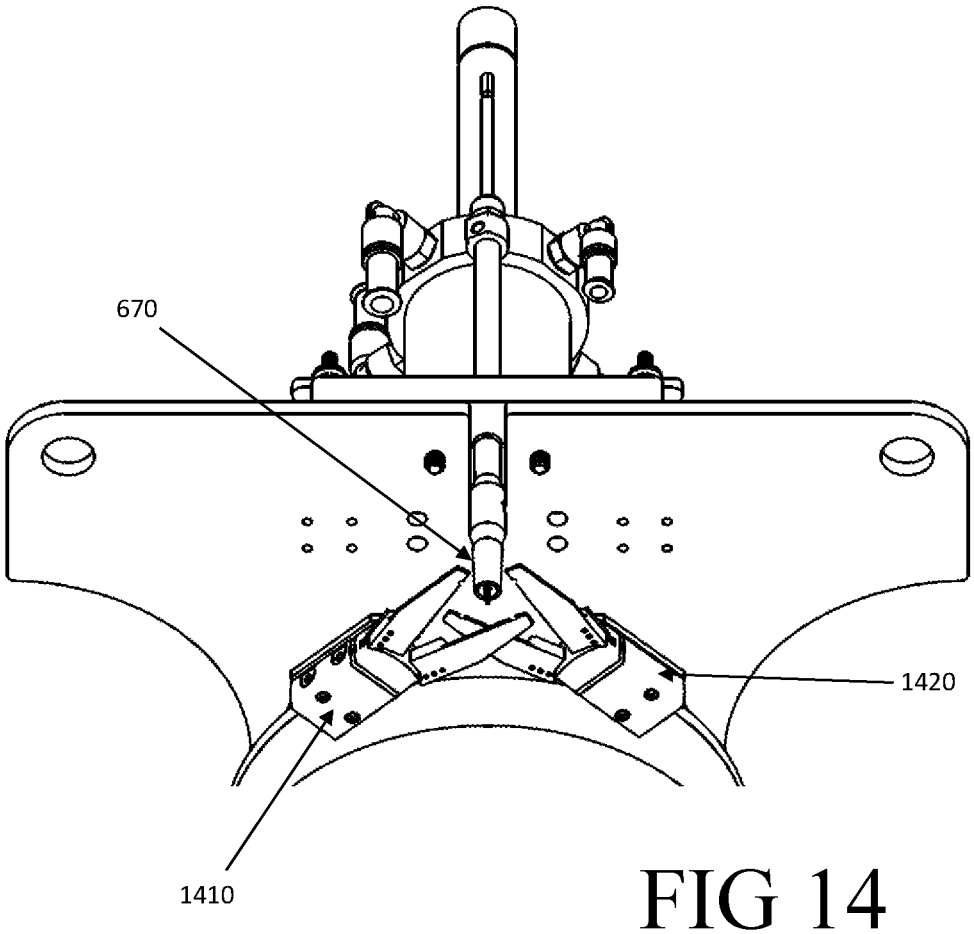
FIG. 14 is a perspective view of an embodiment of folding fingers positioned relative to a folding tip.

With further reference to FIGS. 12, 13, and 22, in another embodiment, cones from the carousel 200 are deposited on a cutting conveyor 1201 (which may have a structure similar to that of the plates of the carousel. The cutting conveyor holds the cone 1000 in a vertical position and moves the cone toward a trimmer head 1202. The trimmer head may include a cutting portion, such as a blade or multiple scissor blades, generally indicated at 1203. A cone positioning system assists with positioning the cone. The present embodiment is in a vertical orientation, though it could be oriented horizontally. A cone lifter 1204 is positioned below the cutting conveyor. The cone lifter may be formed of an actuator 1205 attached to a piston 1206 and plate 1207. Actuating the actuator 1205 moves the plate up and down. The plate contacts the proximal end of the cone to lift the cone to a desired height as shown in FIG. 13. The trimmer head is attached to an actuator 1208 that moves the head with respect to the cone, for example raising (FIG. 12) and lowering it (FIG. 13). The trimmer head may include a positional sensor, such as an encoder assembly (not shown) that provides feedback to the control system to precisely control the location and movement of the trimmer head. The control system includes stored values for particular sized cones. By coordinating the actuation of the cone lifter to contact the proximal end of the cone and lift the cone, and the height of the trimmer head with respect to the cone and lifting plate 1207, the distance from the proximal end of the cone to the trimming blade 1203 is known for each stored cone value. Thus, differently sized cones can be precisely trimmed to identical lengths regardless of manufacturing tolerances of generally sized cones.

Figure 2B:
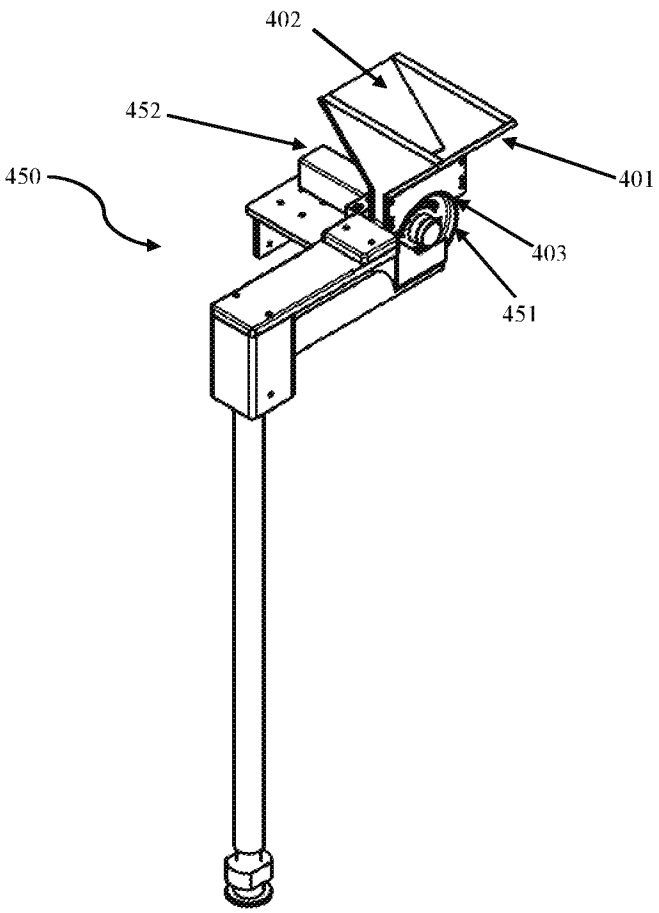
FIG. 2B is an alternative perspective view of an embodiment of a grinder hopper and wheel.
Figure 2A:
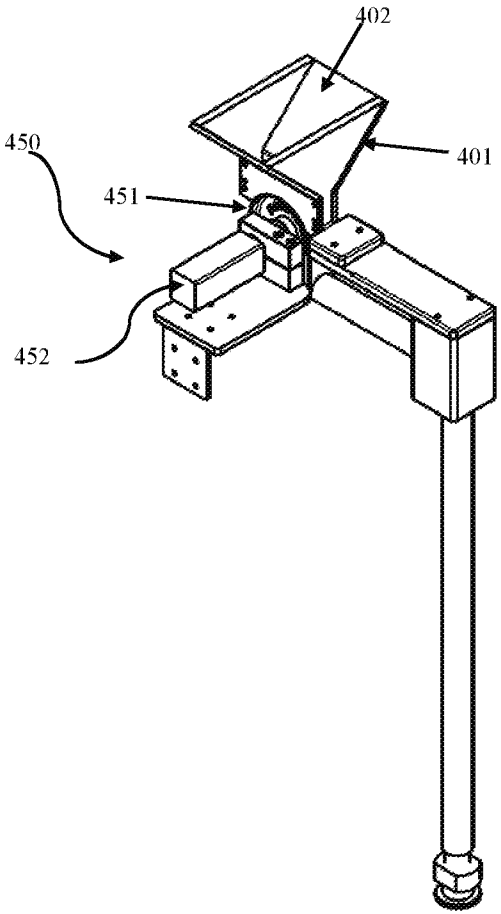
FIG. 2A is a perspective view of an embodiment of a grinder hopper and wheel.

FIGS. 2A and 2B depict one embodiment of a grinder hopper assembly 450 that may be utilized. The grinder hopper assembly 450 includes a hopper 401 having a hopper inlet 402 and a hopper outlet 403. At the outlet of the hopper is a wheel 451 that is operated by a wheel actuator 452. The wheel may include a textured surface so as to function as a grinding wheel. In one embodiment, the hopper inlet 402 funnels toward the hopper outlet 403, and the outlet is approximately the same width as the wheel 451. A portion of the wheel fits within the hopper outlet so as to substantially block the flow of leaves out of the hopper while leaving a gap between a surface of the wheel and a portion of the hopper. The control system sends a signal to the wheel actuator to drive the wheel. When leaves are in the hopper, as the wheel spins it draws leaves through the gap between the wheel and the hopper. When a textured wheel is used, the spinning of the textured wheel may grind the leaves as the leaves are forced between the surface of the wheel and the hopper at the hopper outlet. As the leaves exit the outlet, they may be deposited into a conveyor or alternatively deposited directly into a weigh station or other subassembly.

The grind hopper 401 is prone to a buildup of heat due to the friction created by the spinning wheel 451 and the rubbing of product against product as the product moves through the hopper. It is particularly problematic in that subassembly because, as product heats up, it may have a tendency to clump and release fluid that further leads to a tacky, residual buildup in the hopper, on the wheel, and at the outlet. The buildup restricts the free flow of product through the system. Additionally, as the product clumps, it has a tendency to bridge in the hopper and thereby completely block the flow of product.

Accordingly, both the hopper and the grinding wheel may be connected to a coolant flow circuit that is in turn connected to the refrigeration unit. For example, the hopper may be formed of aluminum and contain a sealed circuitous flow path that enables coolant to flow into the flow path from the refrigeration unit, out of the flow path to a downstream portion of the flow circuit, and eventually back to the refrigeration unit. The coolant is thereby able to chill the hopper and maintain the temperature of the hopper at approximately the temperature of the coolant in the coolant circuit. As the product is fed into the hopper, the cooled hopper in-turn cools and maintains the temperature of the product to prevent the product from releasing fluid. The fluid circuit may also include the grind wheel 451. Coolant may be fed to the wheel through a hose in conjunction with a rotary union, and is then allowed to flow out and continue through the coolant circuit.

FIGS. 7A through 11B depict an embodiment of a product conveyor system equipped with a cooling circuit. The embodiment includes a hopper 7001, one or more conveyors (such as 7002), and a feeder 7004. The hopper may be formed with an hourglass shaped cross-section where an upper chamber tapers toward a narrow neck portion and the lower chamber flares from the neck portion to the conveyor below the hopper. Generally, the upper chamber may be larger than the lower chamber. The hourglass shape helps prevent bridging of product in the hopper. The conveyor may include a gate 7019 to regiment the volume of product exiting the hopper. Because the conveyor 7002 is moving below the hopper, product may pile up and churn at the gate 7019, thereby creating friction and heat. The hopper and conveyor may be connected to a cooling circuit to dispel the heat and keep the product cool.

Various portions of the product conveyor system may be connected to a cooling circuit. As shown in FIGS. 7A-11B, the hopper 7001 may include cooling plates 7010, 7011, 7012, 7013. In one embodiment, the cooling plates contain an internal path through which a coolant fluid may flow. The cooling plates may be connected by hoses, for example, 7014, 7015, which may in turn be connected to additional cooling plates to and a coolant reservoir (not shown) to form a cooling circuit. Additional cooling plates may be provided in association with the conveyor(s). For example, cooling plate 7016 and 7017 cool conveyor belt 7002. In that way, the hopper and conveyor belt are able to keep the product cool as it moves through the system.

Feeder 7004 is shown in FIGS. 10A-11B. The feeder may include channel 7018 to guide product on the conveyor toward the end of the conveyor and prevent excess product from building up and spilling over the conveyor. In the depicted embodiment, the channel is comprised of a pair of plates 7020 and 7021. The feeder may also include a grinding wheel 451 and a dynamic gate 7022. In one embodiment, the surface of the conveyor 7002 may be the grinding wheel as it rotates past the dynamic gate 7022. The dynamic gate may be formed of a gate plate 7023 and a linkage 7024 that is connect to a pin 7025 that is eccentrically mounted to a wheel 7026. The gate plate 7023 may also be connected to the plates 7020 and 7021 by pin 7030 so as to allow the gate plate to pivot with respect to the plates. The wheel may be connected to an actuator 7027. The actuator is further connected to a controller of the machine, such as a computer or microprocessor. The controller is able to transmit instructions to the actuator to rotate the wheel and thereby control the operation of the dynamic gate. In one embodiment, the actuator is controlled intermittently such that it rotates the wheel 7026 clockwise to open the gate, then counterclockwise to close the gate and press the leaves against the grinding wheel 451. In that way, the dynamic gate may be pulsed against the grinding wheel repeatedly to simultaneously allow leaves to pass and grind leaves. Also, by controlling the gate and how far the wheel 7026 is rotated counter clockwise, the coarseness of the grind of the product can be controlled.

Additionally, the conveyor and dynamic gate may be controlled by the control system which also receives feedback from the weigh station. The controller monitors the feedback of the weigh station and utilizes that feedback to control the speed of the conveyor and the operation of the dynamic gate. When the weigh station indicates that there is little weight, the speed of the conveyor increases and the dynamic gate is opened to provide a larger gap. As the weight increases, the speed of the conveyor is decreased and the dynamic gate is forced closer to the grinding wheel to grind the product more finely and slow the deposit of the product into the weigh station. The control system stores in memory a set weight for a product (e.g. the amount of product necessary to fill one cone). As the weight approaches the set weight, the controller reduced the speed of the conveyor and adjusts the spacing of the dynamic gate to more precisely control the deposition of product into the weigh station.

In some embodiments, the gate plate 7023 includes an internal fluid pathway that is connected to the cooling circuit, for example by hoses 7028 and 7029. The cooling circuit helps maintain the product at a cool temperature, preferably between 35° F. and 55° F. during the packaging cycle. It was found that utilizing the cooling circuit of the present system in conjunction with a coolant fluid in the range of 35° F. and 40° F. was sufficient to maintain the preferable temperature of the product during the packaging cycle. Lower temperatures risk creating ice crystals from ambient humidity which could negatively impact the process, and higher temperatures tended to be ineffective for overcoming the heat generated in the system. The product may be fed from a refrigerated container into the hopper 7001. The cooling circuit maintains the temperature of the hopper, conveyor, dynamic gate and grinding wheel, and thereby controls the temperature of the product being fed as it moves through the system to be deposited into cones by dissipating heat, for example that may generated through friction.

Figure 11B:
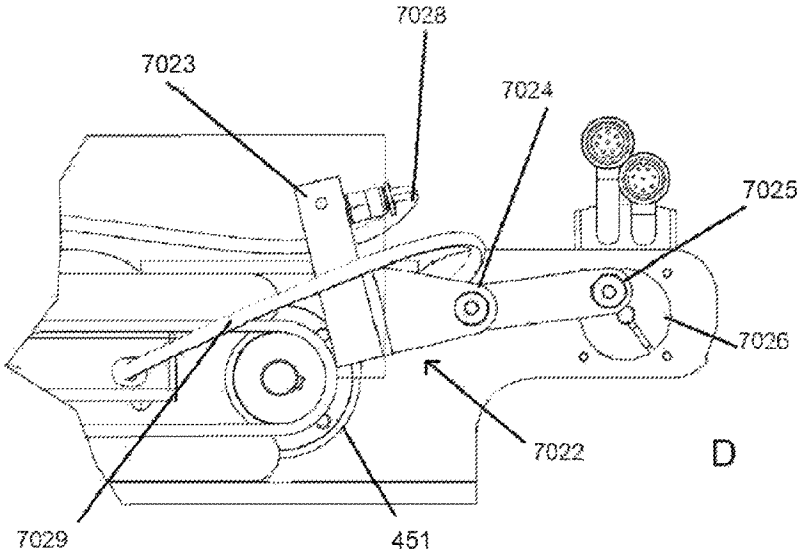
FIG. 11B is an enlarged side view having plate 7020 removed and showing a portion of the feeder assembly.
Figure 11A:
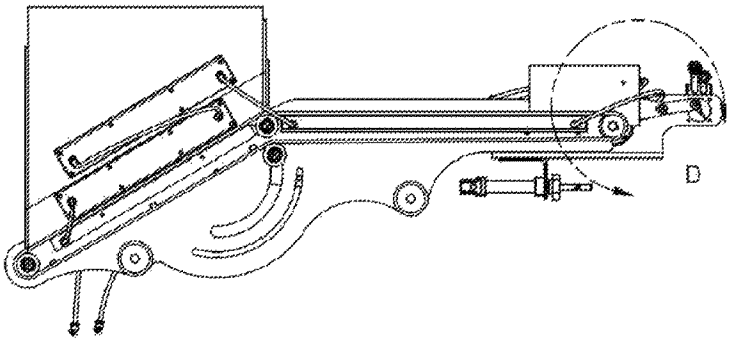
FIG. 11A is a side view of an embodiment of a hopper, conveyor and feeder assembly and including an indication of the portion of the assembly enlarged in FIG. 11B.
Figure 11C:
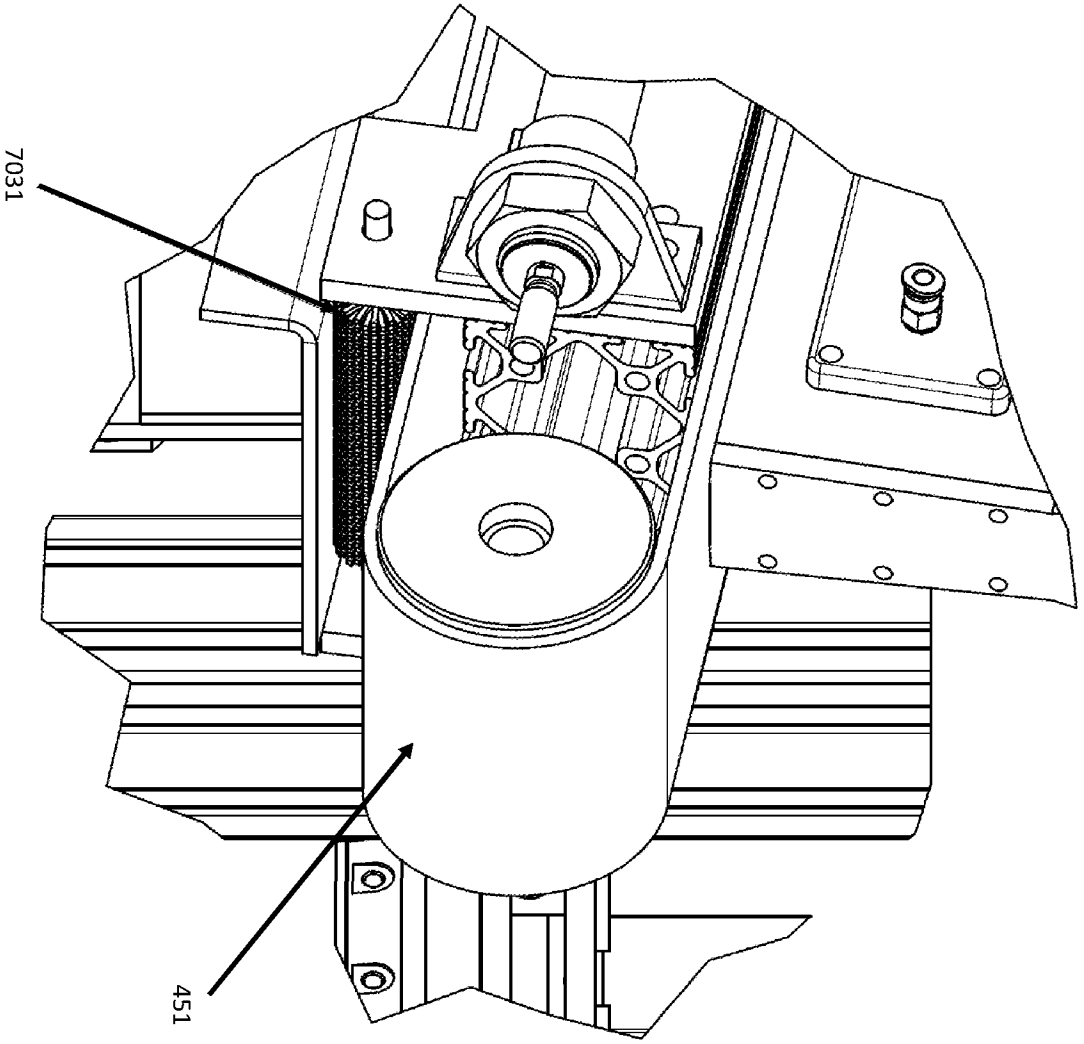
FIG. 11C is a perspective view of an alternate embodiment of a portion of the feeder assembly including a cleaning brush.

FIG. 11C is a depiction of an alternate embodiment of the feeding system. For clarity, the dynamic gate has been removed. Even with the chillers, particulate can still amass on the conveyor. To prevent excessive buildup of particulate, cleaning brush 7031 may be positioned beneath the conveyor. In some embodiments, the brush 7031 is moved by an actuator (not shown) to rotate in the opposite direction as the movement of the conveyor. Thus, after the conveyor deposits material into the packing head, the conveyor continues along its path and the cleaning brush rotates opposite to the conveyor to brush and clean remnant particulate off of the conveyor.

Figure 17A:
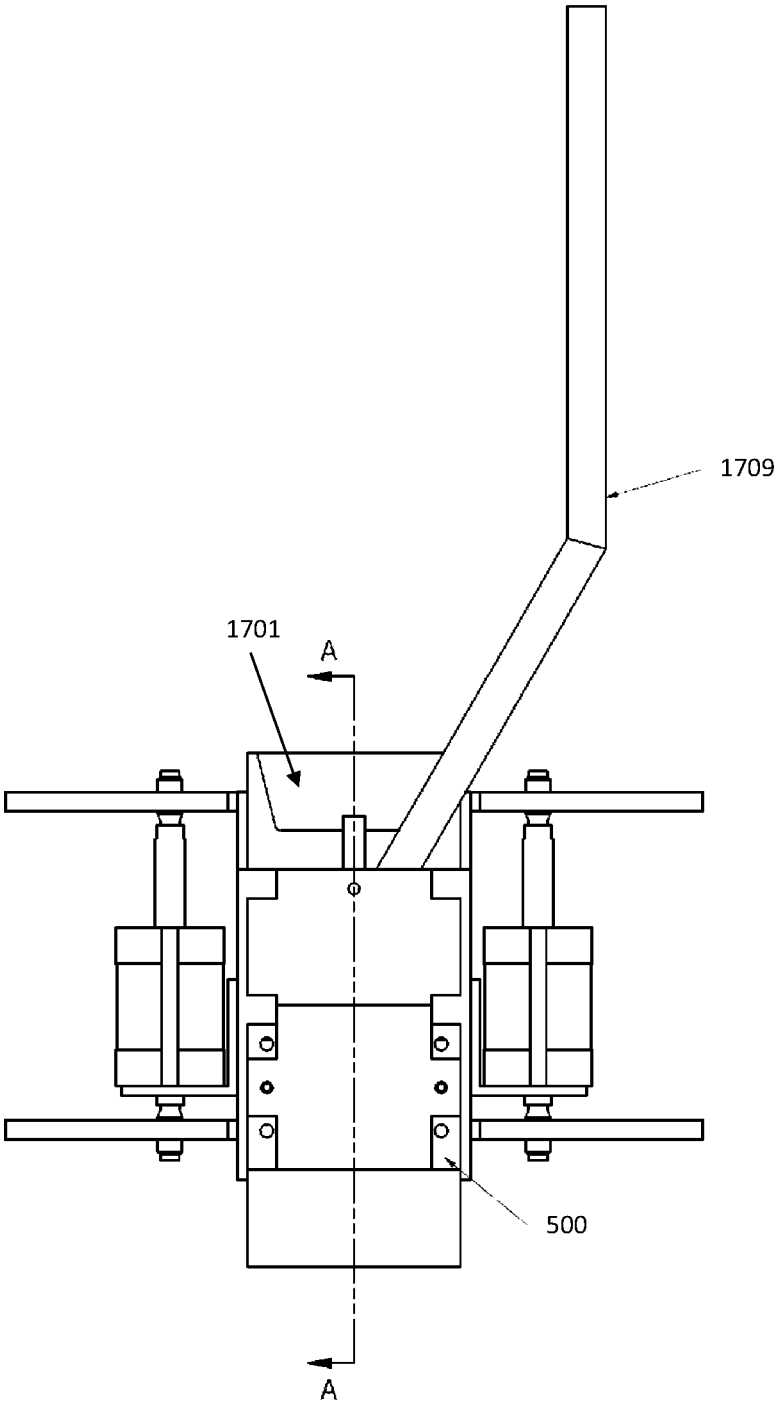
FIG. 17A is a front view of an embodiment of a packing station.
Figure 17B:
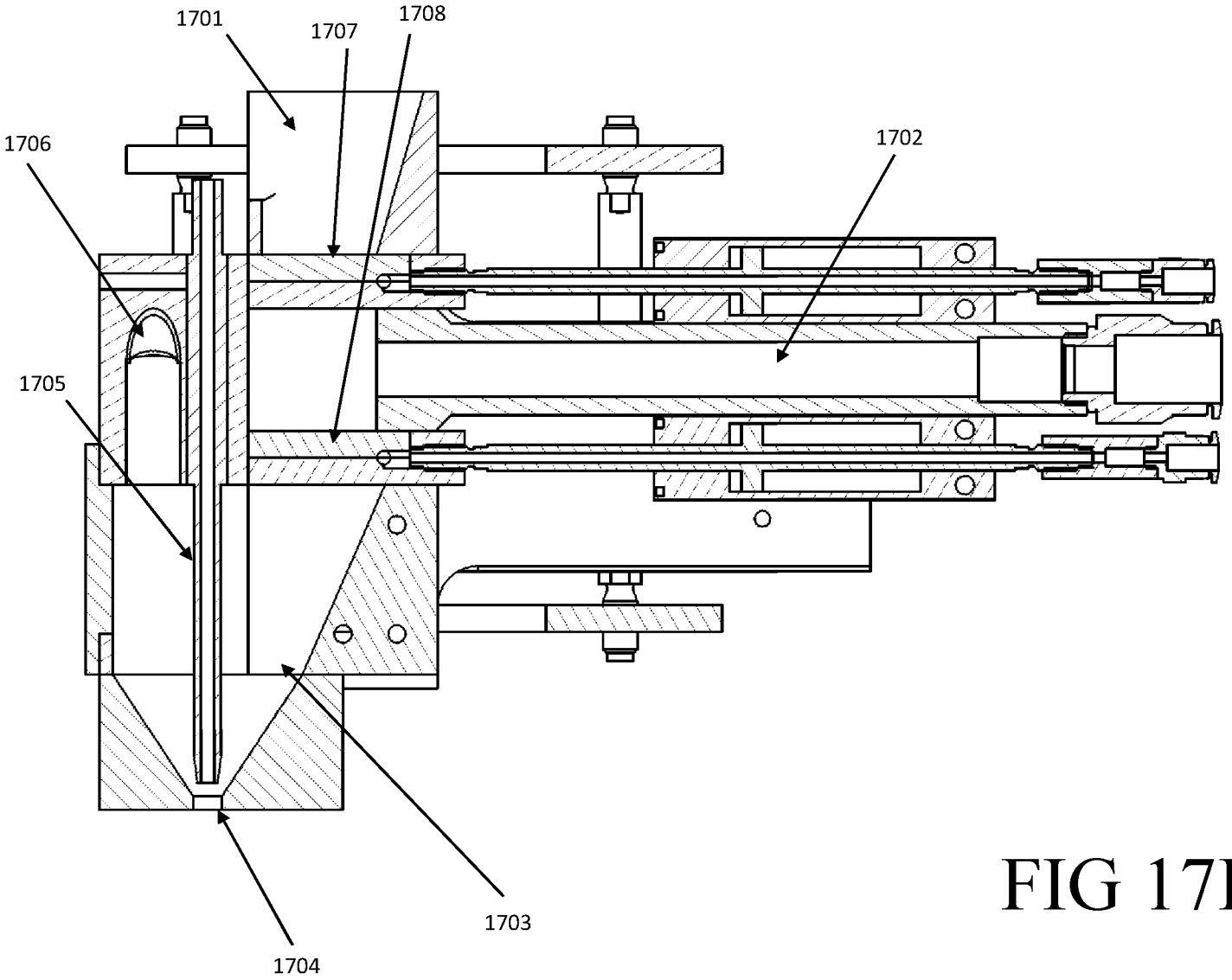
FIG. 17B is a side, cross-sectional view of an embodiment of a packing station along line A of FIG. 17A with gates in a closed, packing position.
Figure 17C:
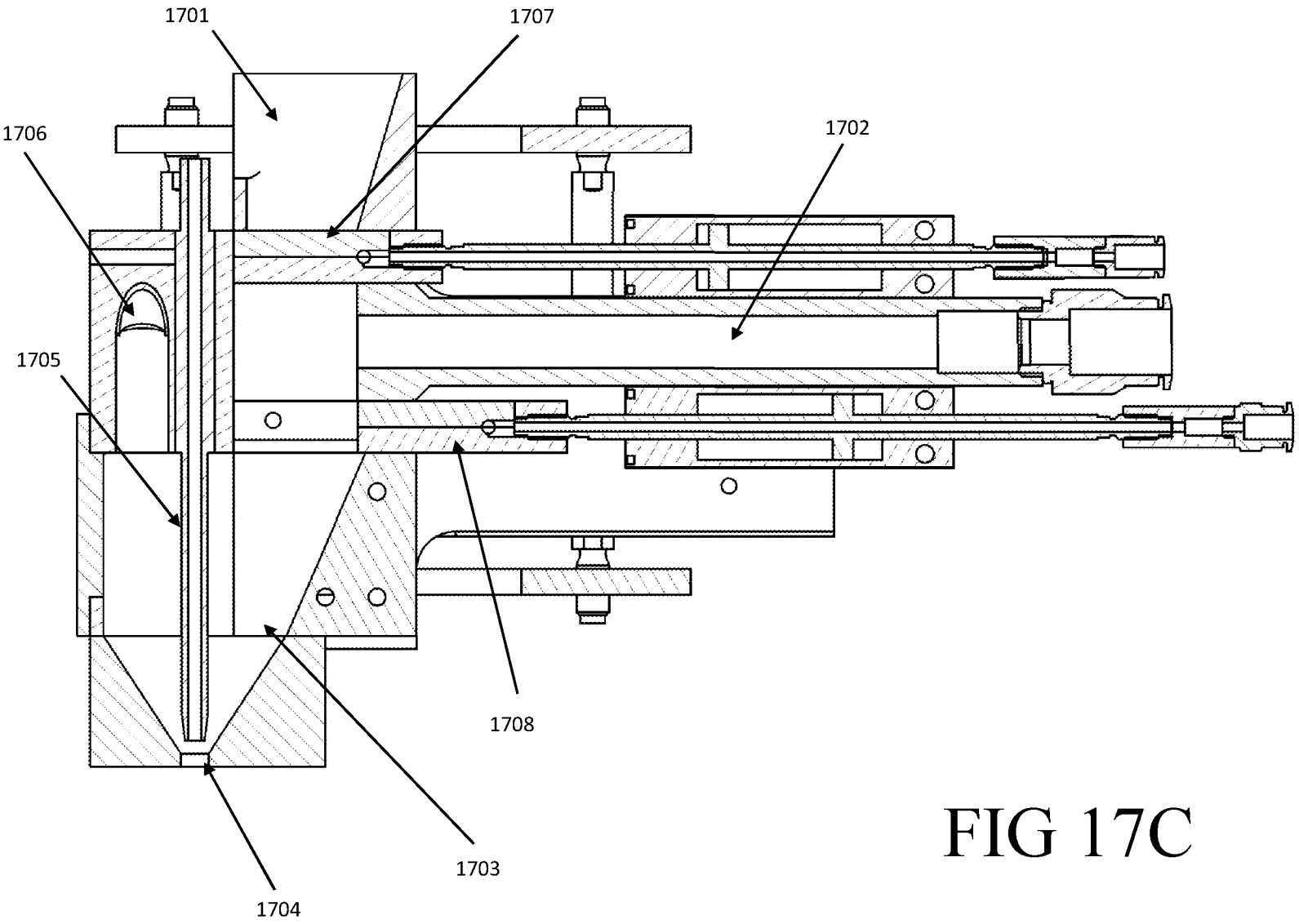
FIG. 17C is a side, cross-sectional view of an embodiment of a packing station along line A of FIG. 17A with one gate closed and one gate open.
Figure 17D:
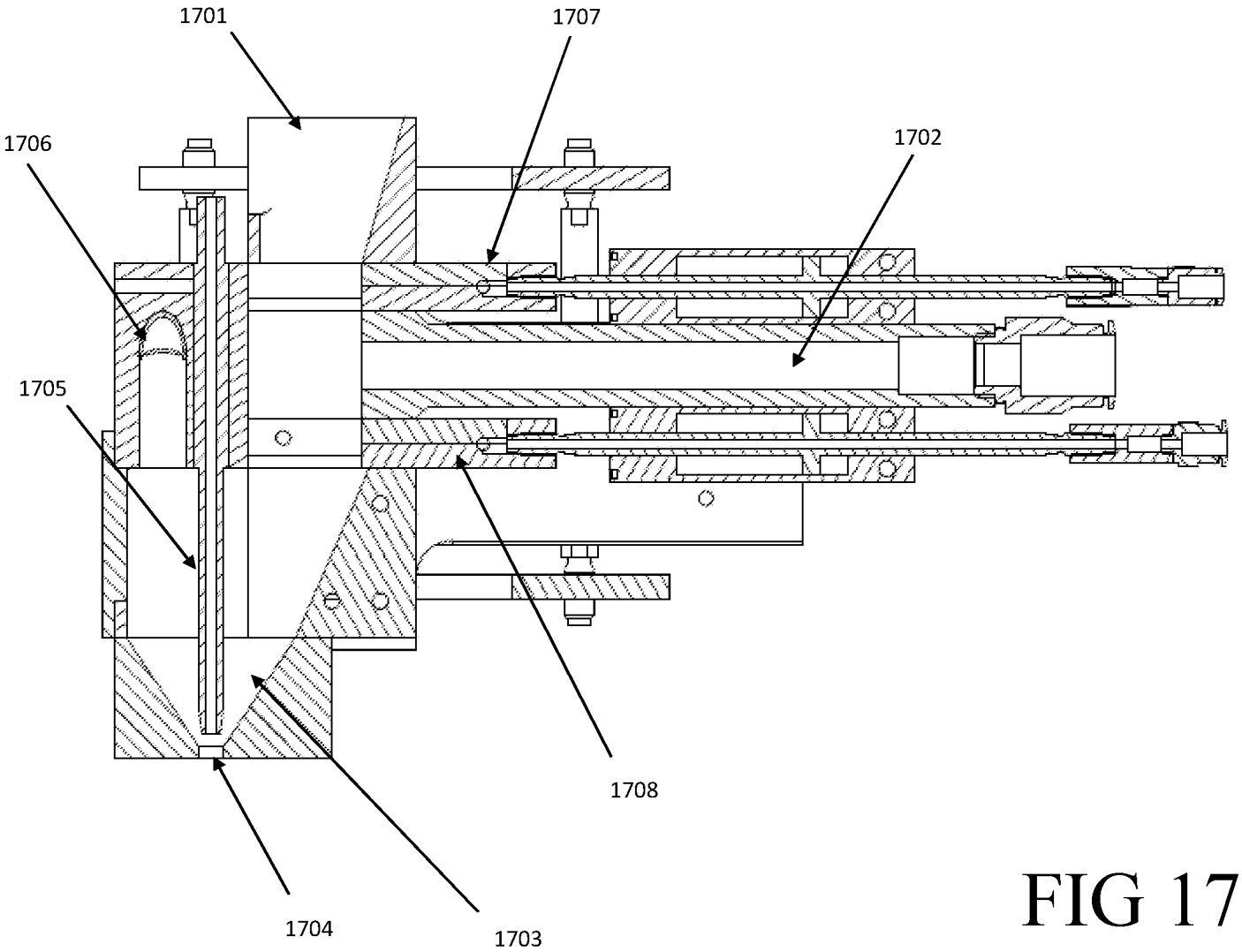
FIG. 17D is a side, cross-sectional view of an embodiment of a packing station along line A of FIG. 17A with gates in an opening, filing position.

With reference to FIGS. 17A-17D, an embodiment of a packing station is shown. The product is fed into a packing station 500 for packing into a cone. In one embodiment, the packing station includes an inlet 1701, an evacuation pathway 1702, a packing chamber 1703 terminating at an outlet 1704, packing rod 1705, and an exhaust port 1706 in communication with the packing chamber. The packing station may also include one or more gates to open or close sections of the packing chamber. For example, the packing station may include inlet gate 1707 at the inlet, prior to the evacuation pathway, and an evacuation gate 1708 between the evacuation pathway and the packing chamber. As shown in FIGS. 17B-17D, the gates may be selectively opened and closed such that product can flow into the packing chamber with both gates opened, the size of the packing chamber can be restricted by closing both gates or gate 1708, and the evacuation gate 1708 may be opened to allow the application of suction to the packing chamber to clean out residual particulate.

When packing, the particulate is deposited into the packing chamber, the packing rod is reciprocated to selectively allow particulate to pass through the outlet and into a cone positioned below the outlet 1704. The packing rod may be a hollow tube through which pressurized gas may be provided to the cone when packing. As air bursts are applied, the air will push back up into the packing chamber. To alleviate pressure, the air is allowed to pass out of the packing chamber via the exhaust port 1706. It was found that particulate would tend to be carried as well. To prevent the escape of particulate and control the flow of air, the exhaust port many be fitted with an exhaust chimney 1709. In one embodiment, the chimney is approximately 10-20 inches in length. Air passes through the chimney, but due to the length, particulate cannot escape. The carried particulate falls back into the chamber and may then be further packed into the cone.

Because the particulate is manipulated during the packing process, heat can buildup in the packing chamber. To counteract the heat, in one embodiment, the structure forming the packing chamber 1703 is cooled which in turn helps keep the particulate product cool.

Keeping the product cool further helps when injecting a fluid core. After the product is packed into cones, the filed cones are ready for a fluid injection. To keep the fluid free flowing, it may be heated. Because of that, depending on the type of fluid utilized, the fluid may undergo a decarboxylation process. For example, before the heating and injection process occurs at the fluid injection station, a concentrated oil extract may first be decarboxylated using techniques known in the industry (such as by heating the oil for extended amounts of time until the bubbling ceases in the liquid). This step is necessary for certain extracted concentrate oils (e.g. shatter, batter, sauce, live resin extracts) because those oils will off-gas and bubble when heated to the point of sufficiently low viscosity for fluid injecting. The bubbles can interfere with the pumping mechanism and fluid circuit by creating variable pressure when pumping (e.g. air pockets in the fluid lines) resulting in inaccurate amounts of the oil being injected. Thus, by first decarboxylating the oil, the fluid injection station can reliably heat the fluid without disrupting the fluid flow and pumping process to thereby reliably inject the fluid into the cone.

With reference to FIGS. 18A-18D and FIG. 19, one embodiment of the fluid injection station includes multiple singular-directional flow paths. Generally, the fluid injector station 1800 includes a reservoir 1801 an actuator 1802 and pump 1803 for the positive flow path, an actuator 1804 and pump 1805 for the negative flow path (though in some embodiments the respective actuator and pump are integrated into respective single pump units), and a needle actuator 1806 that raises and lowers an injector needle 1811.

The positive flow path flows fluid from the reservoir toward the injector needle. By contrast, the negative flow path draws fluid from the needle out, through the negative flow path and back to the reservoir. In one embodiment, the positive flow path draws fluid from the bottom of the reservoir, while the negative flow path deposits fluid toward the top of the reservoir. That allows fluid from the negative flow path, which may contain air bubbles due to cavitation from reversing fluid flow at the needle, to be deposited at the top of the reservoir and settle in the reservoir before reaching the positive flow path. Thus the system prevents the formation of air bubbles in the fluid that is injected using the needle, particularly at the point of injection where the fluid occupies a cavity within the needle.

Figure 18A:
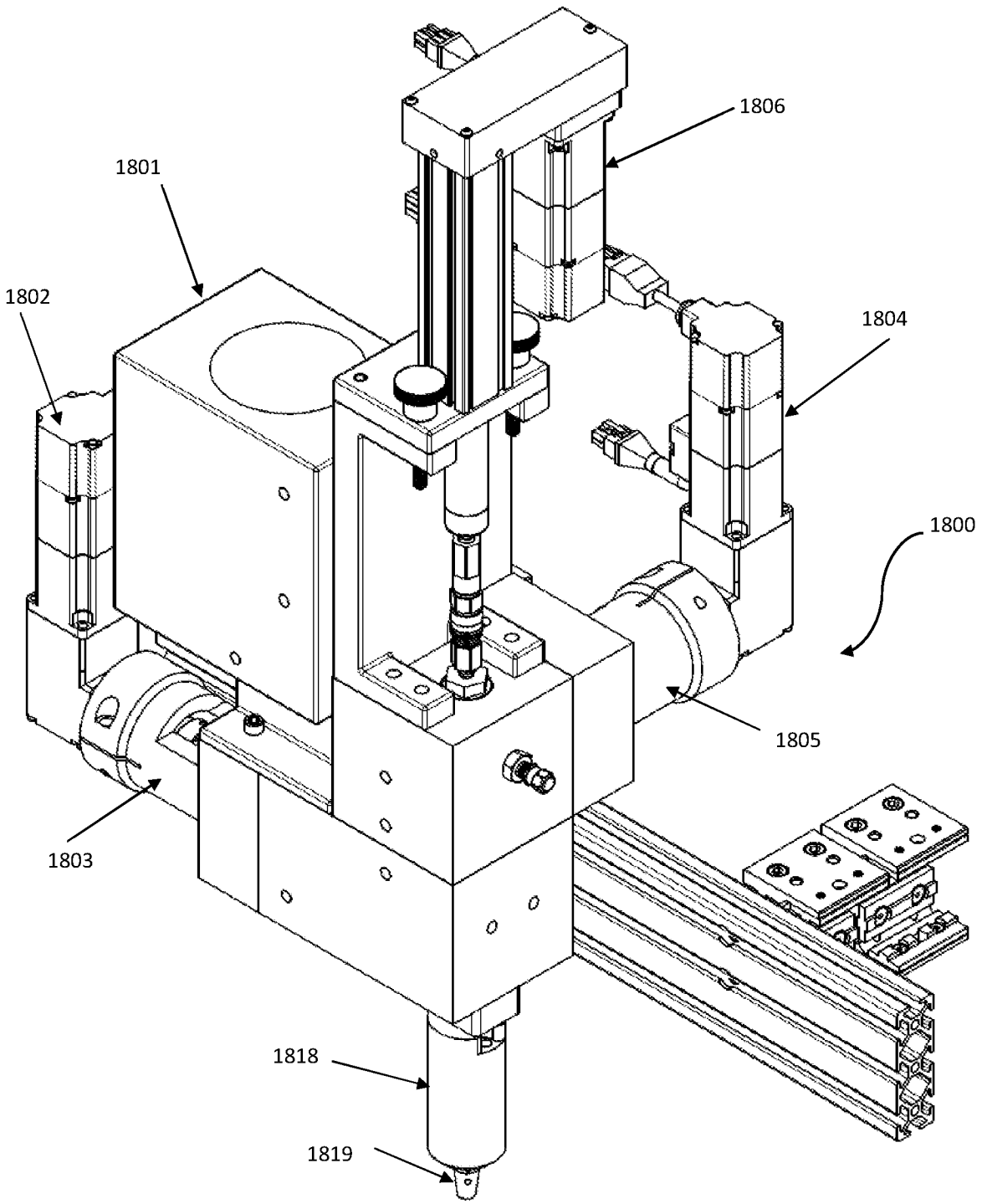
FIG. 18A is a perspective view of an embodiment of a fluid injector station.
Figure 18B:
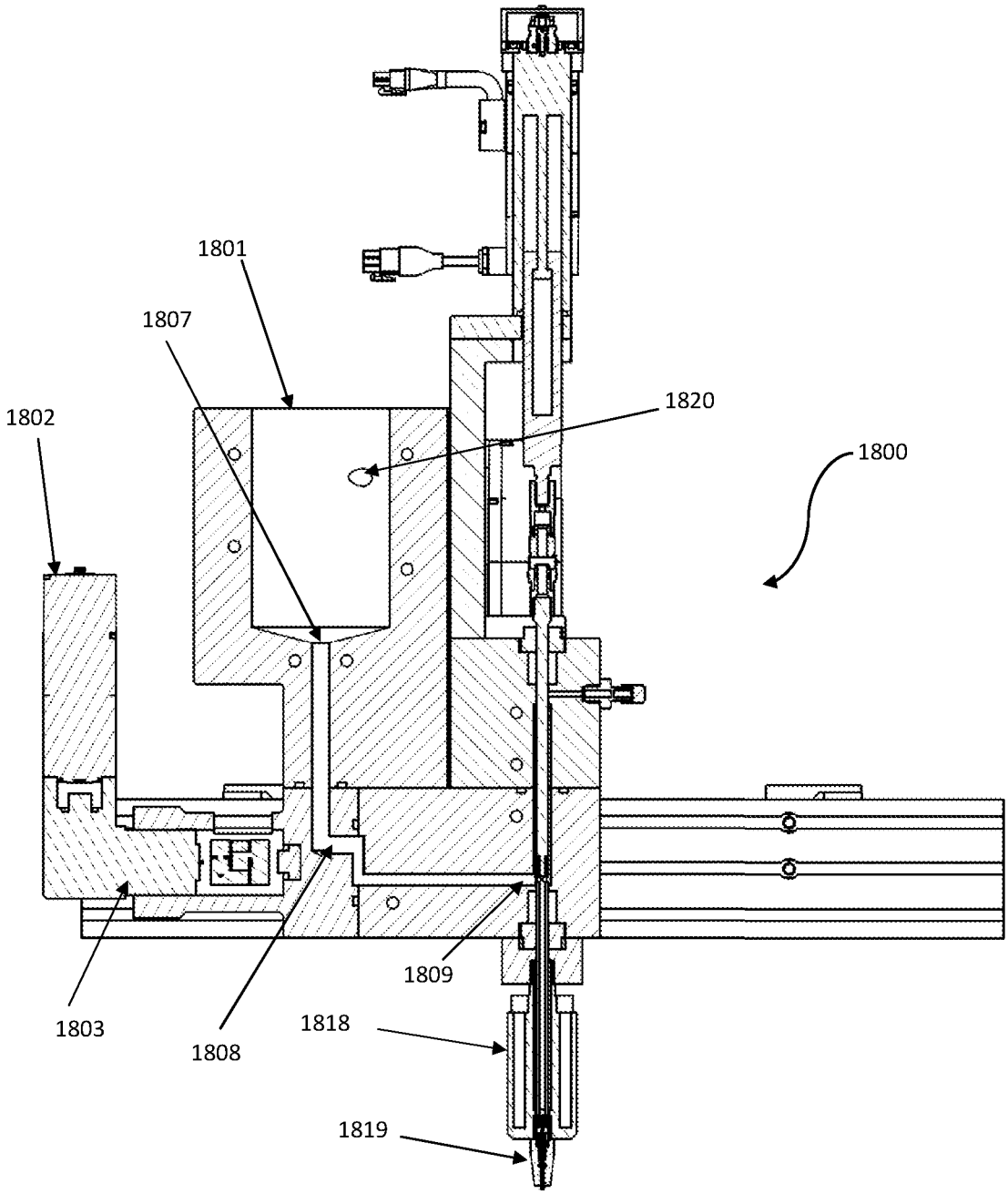
FIG. 18B is a cross-sectional view of the front of an embodiment of a fluid injector station depicting the positive pressure fluid flow path.

FIG. 18B depicts and embodiment of the positive flow path. Actuator 1802 controls the operation of pump 1803 to flow fluid through positive flow path 1808. The pump draws fluid from reservoir 1801 though port 1807 at the bottom of the reservoir. The pump forces the fluid through the positive flow path toward outlet port 1809 where the fluid then passes into the needle and further out of the needle as desired. In some embodiments, at least a portion (and in some embodiments a majority of the length) of the needle is further surrounded by a heater 1818 and nozzle 1819. The heater is connected to the control system to control the temperature of the needle, and by extension, the fluid at the point of injection. The nozzle is of similar shape to the folding tip. Thus, alignment of the hole in the distal end of the particulate filled cone with the needle (which is coaxial with the nozzle) is facilitated by the nozzle which mates with the distal end and the raised rim portion of the distal end of the cone. It was found that utilizing the heaters to maintain a fluid temperature of between 100° F. and 120° F., and optimally approximately 110° F. provided the optimal flow viscosity for most injecting fluids while preventing cavitation during the injection process.

Figure 19:
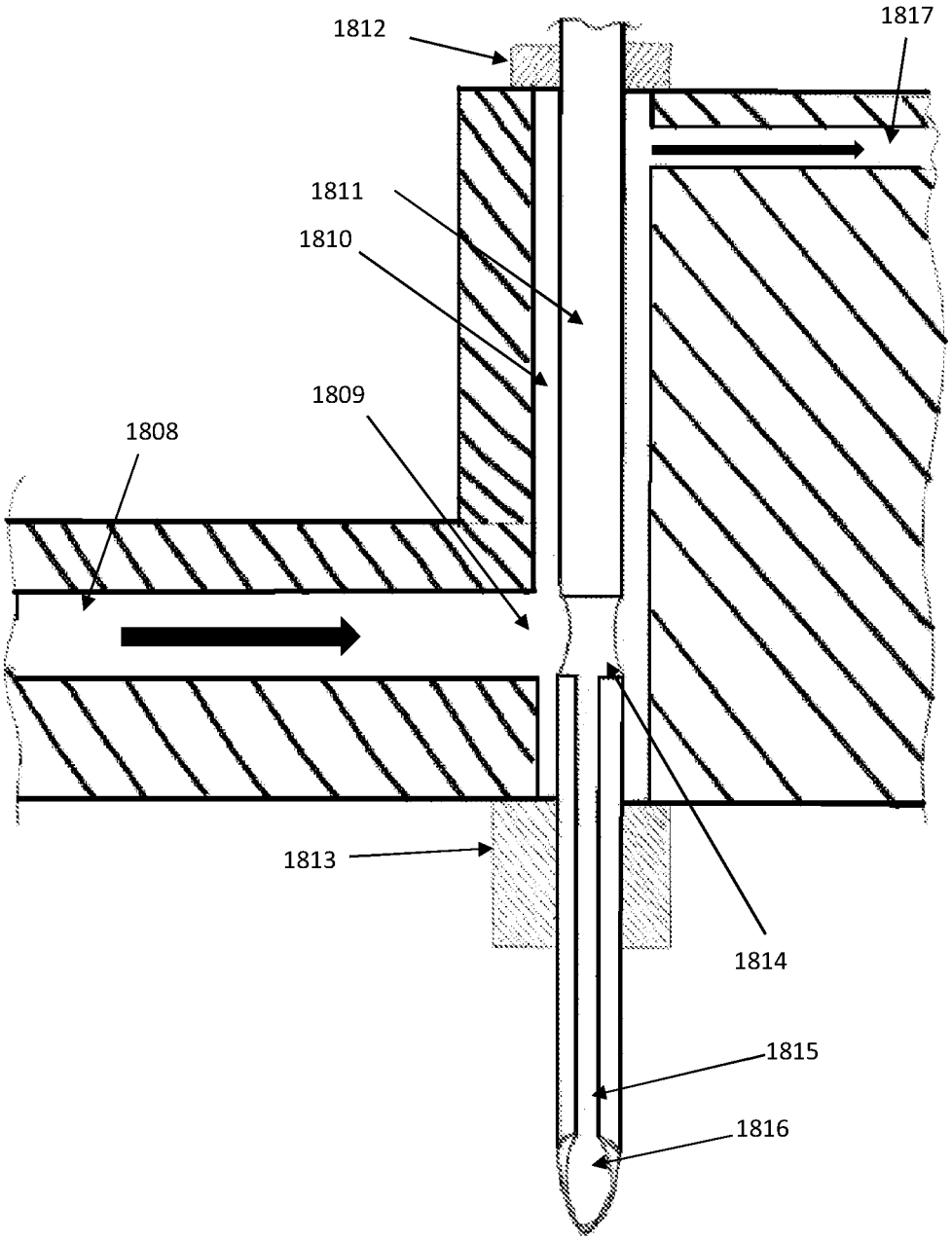
FIG. 19 is a cross-sectional view of an embodiment of the injector needle and flow paths of an injector station.

As shown in FIG. 19, positive flow path 1808 ends at port 1809 which empties into chamber 1810 that houses needle 1811. Gaskets 1812 and 1813 seal the chamber around the needle to prevent fluid from leaking out of the chamber while allowing the needle to reciprocate within the chamber 1810. The needle includes shaft hole 1814 that is a pathway extending through the entirety of the needle shaft. The needle includes a pathway 1815 connecting the shaft hole and the needle outlet 1816 which allows fluid to flow from the chamber through the shaft hole, through the needle pathway and out the needle outlet. Direction of fluid flow in the positive and negative paths is depicted by the arrows.

Figure 18C:
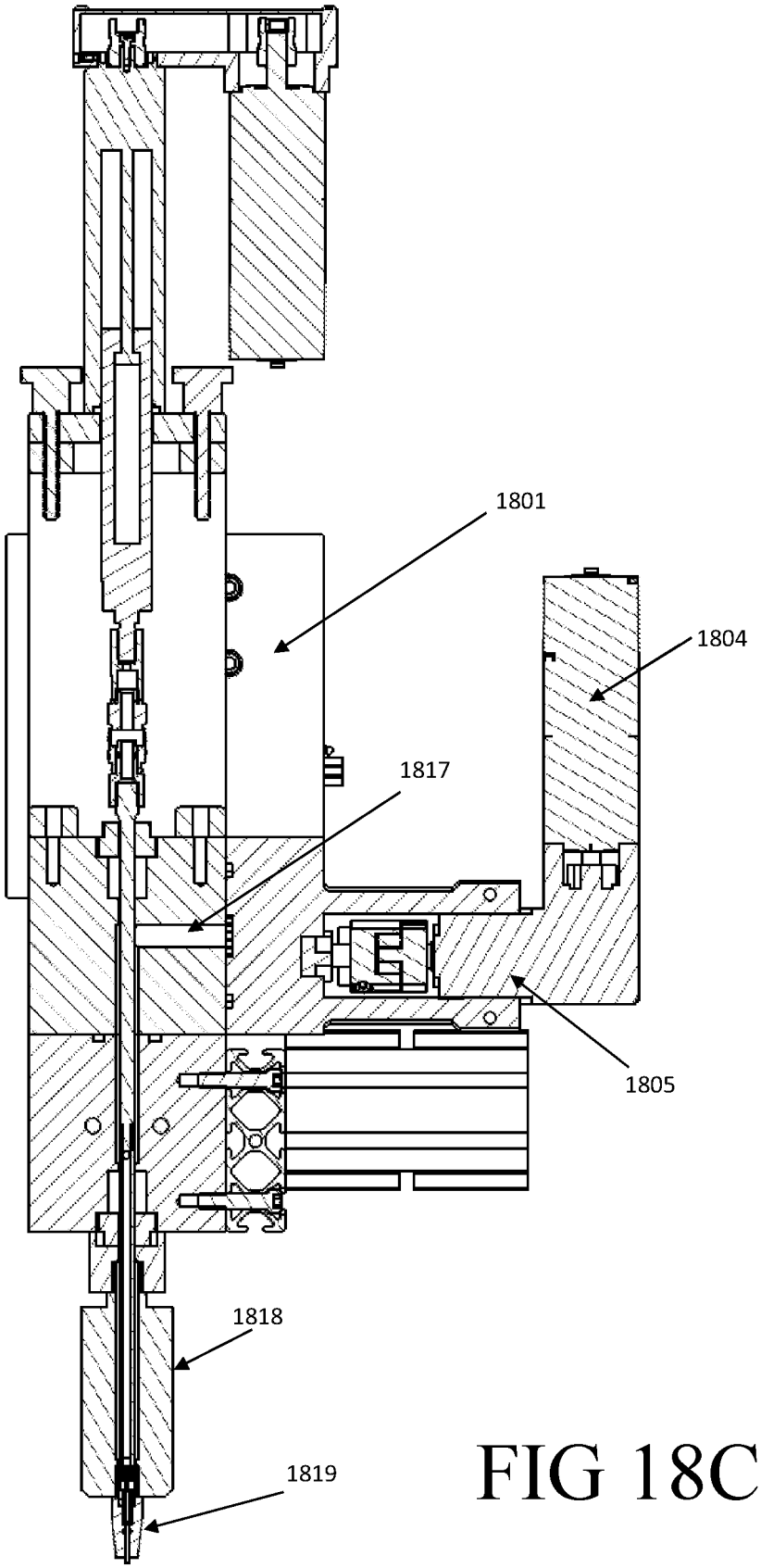
FIG. 18C is a cross-sectional view of the right side of an embodiment of a fluid injector station depicting a portion of the negative pressure fluid flow path.
Figure 18D:
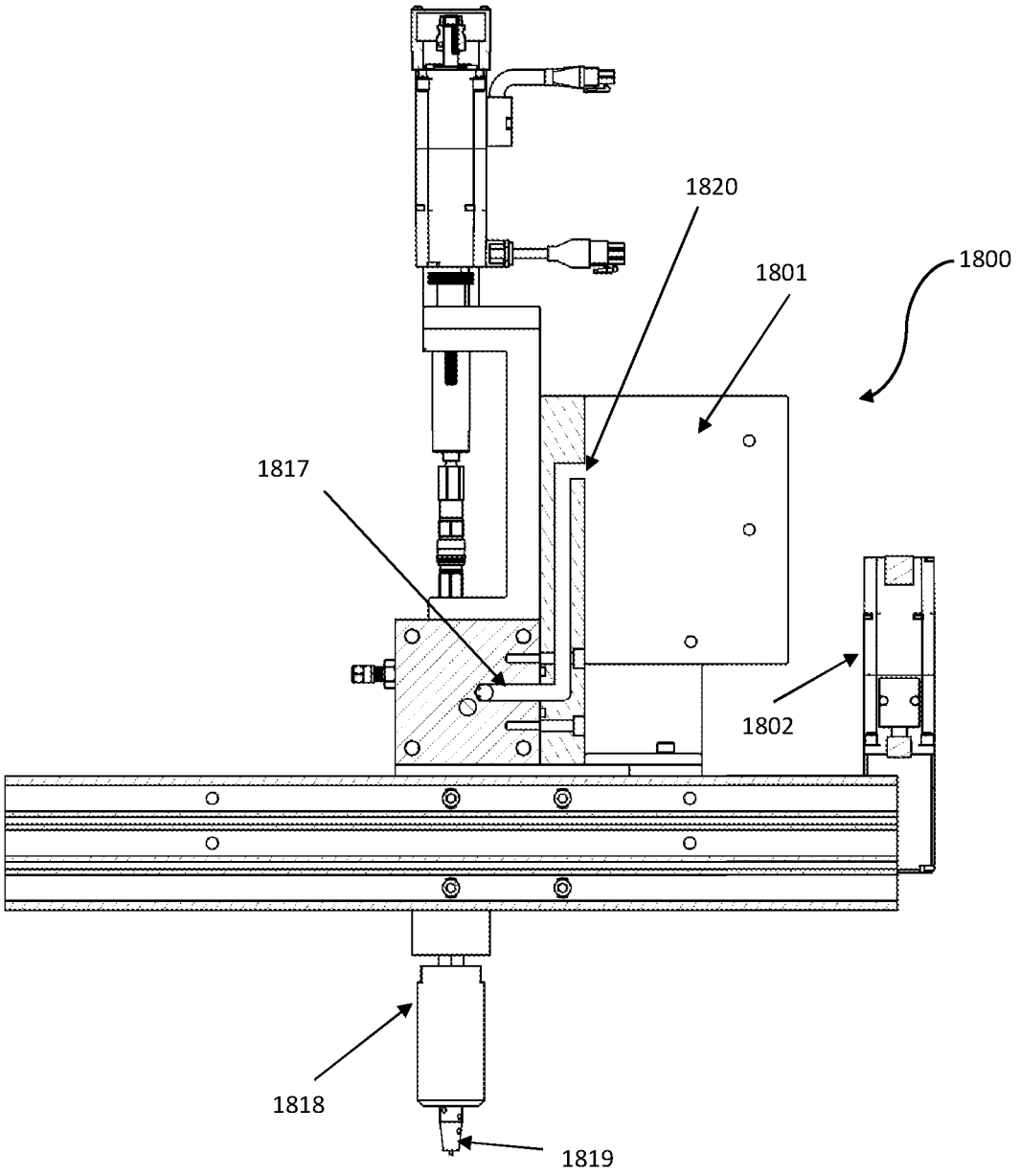
FIG. 18D is a cross-sectional view of the back of an embodiment of a fluid injector station depicting a portion of the negative pressure fluid flow path.

Negative pathway 1817 connects to the chamber 1810. As shown in FIGS. 18C and 18D, the negative pathway 1817 leads from the chamber back to the reservoir 1801 to flow into the reservoir at return port 1820. Negative pressure is applied to the negative pathway to draw fluid out of the chamber. The suction created in the chamber creates negative pressure in the needle pathway 1815 which withdraws fluid back up the needle and out of the shaft hole 1814. Thus, by applying positive and negative pressure, fluid is flowed through the positive pathway and out of the needle and withdrawn from the needle and out of the negative path without reversing fluid flow in either the positive or negative pathways.

If the flow of fluid is not controlled, cavitation tends to occur at the needle shaft hole 1814 as fluid is pushed forward and reversed through the shaft hole 1814. In one embodiment, the needle is sized and the pump actuators are synchronized such that by applying suction to withdraw fluid out of the shaft hole and up into the chamber 1810, the majority of the turbulent fluid can be raised above the shaft hole and fresh fluid from the positive flow path can be pumped into the needle. That limits the amount of fluid in the system that is being pushed forward and backward to only the amount of fluid in the needle, the majority or all of which is expelled on successive injection cycles so that the fluid in the needle only experiences flow reversal once or twice before being expelled. Once a fluid is injected, it is preferable that the fluid is chilled to prevent the fluid from oversaturating the product. By keeping the product cool during the packing stage, the product itself assists in cooling the fluid as the fluid is injected into the center of the cone. Thus, the cool product helps reduce the temperature of the fluid during injection, increasing fluid viscosity and maintaining the fluid as a central core within the cone. The filled cones may then be transported to a refrigerated chamber to further chill the fluid.

Figure 3:
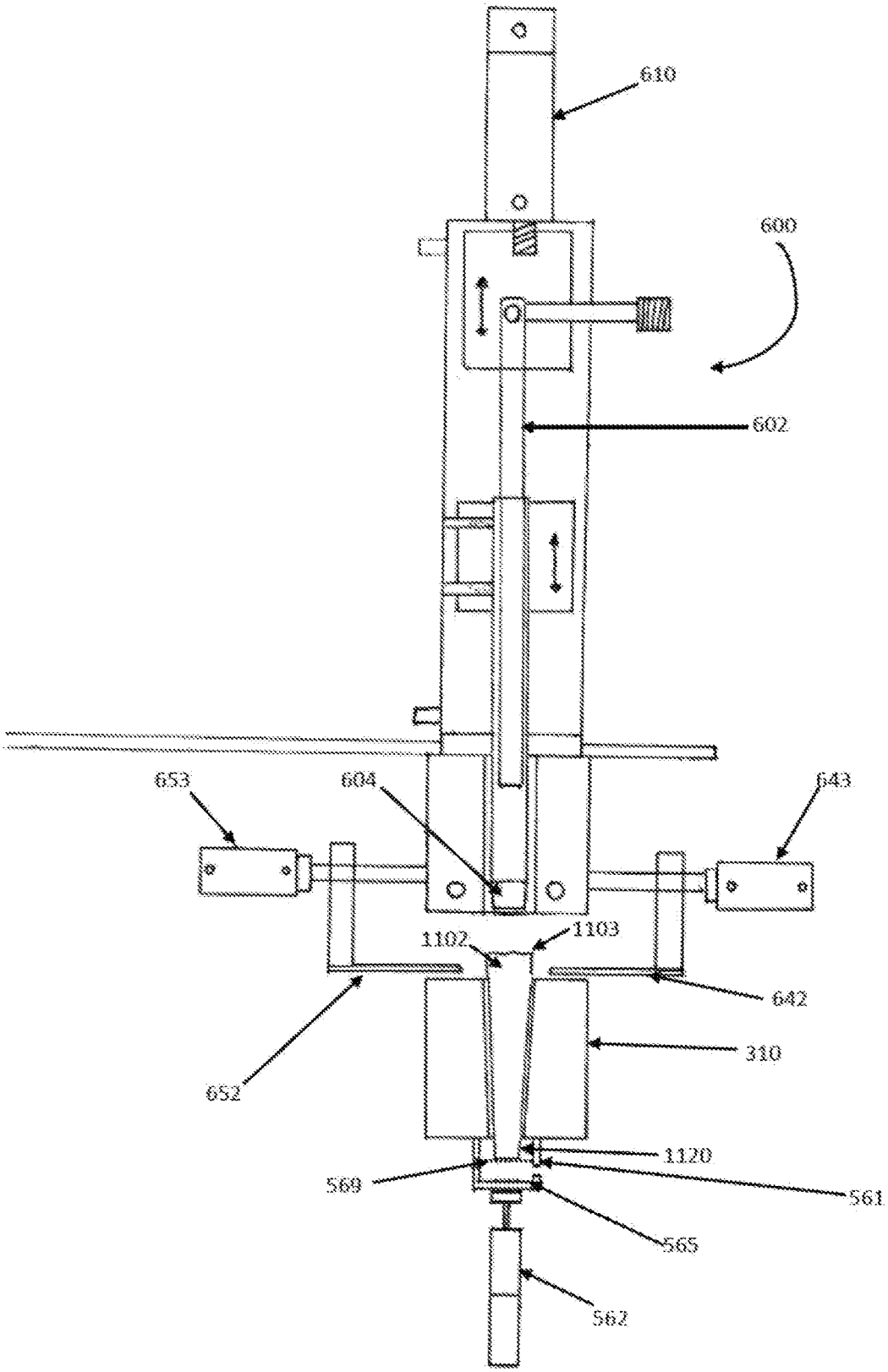
FIG. 3 is a cross-sectional side view of an embodiment of a folder station with an unfolded cone.

FIG. 3 generally depicts one embodiment of a folder station 600. The folder station may include a housing that accommodates a folding rod 602. A folder tip 604 is affixed to (or integrated with) a distal end of the folding rod 602, while a proximal end of the folding rod 602 is associated with a folding rod actuator 610.

In one embodiment, two folding fingers are utilized. With reference to FIG. 3, one embodiment includes folding fingers 642, 652, and folding finger actuators 643, 653. The folding fingers each include, for example, a substantially V-shaped groove (not shown) that together encompass a distal end 1102 of a cone 1120 when the folding fingers are brought together.

To fold the cone, a die 310, containing filled cone 1120, is oriented below the folding station 600 such that the folder tip 604 and cone 1120 are axially aligned. In one embodiment, a cone support 561 supports the proximal end of filled cone 1120. The cone support may be integrated with or connected to support actuator 562 that may raise to contact (and in some embodiments lift) the filled cone 1120 when the cone conveyor is aligned with the folder tip. The lifting of the filled cone 1120 can assist in ensuring that the distal end 1102 of the cone protrudes from the die 310 for proper folding. In one embodiment, the cone support may attach to the cone (such as through suction or mechanical clamping). In one embodiment, folding finger actuators 643, 653 cause the folding fingers 642, 652 to engage with distal end 1102 of the filled cone 1120 and cause the distal end 1102 of the cone to deform in preparation for folding the cone. The folding fingers converge on the distal end, compressing the paper of the distal end toward the center axis of the cone.

Figure 4A:
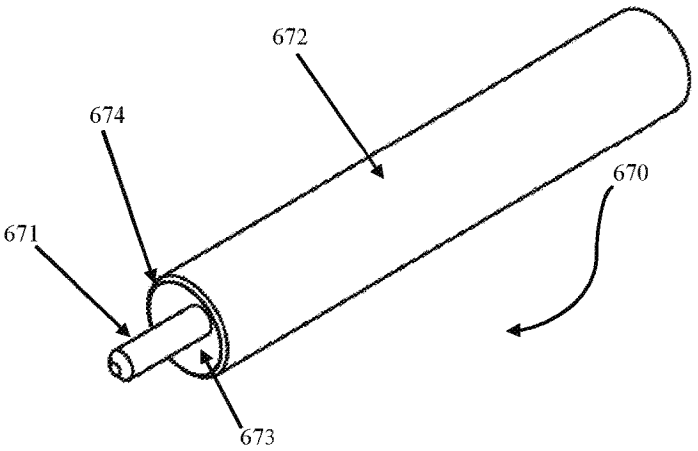
FIG. 4A is a perspective view of an embodiment of a folder tip with an axial pin.
Figure 4B:
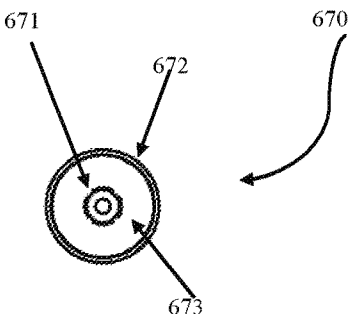
FIG. 4B is a plan view of an embodiment of a folder tip with an axial pin.
Figure 4C:
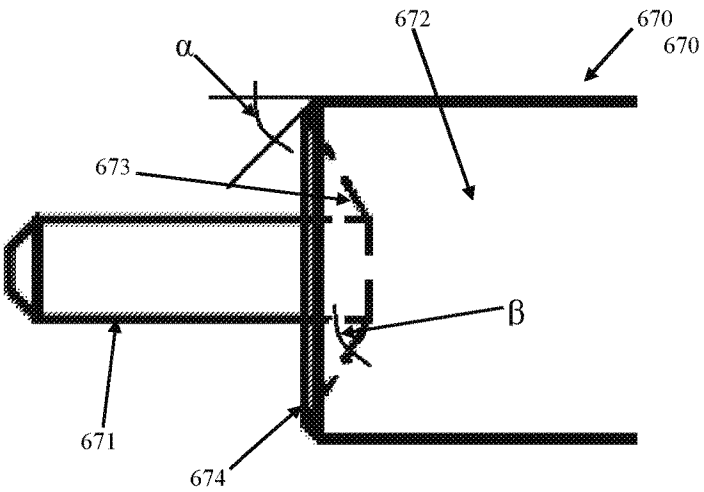
FIG. 4C is a cross-sectional side view of an embodiment of a folder tip with an axial pin.
Figure 5B:
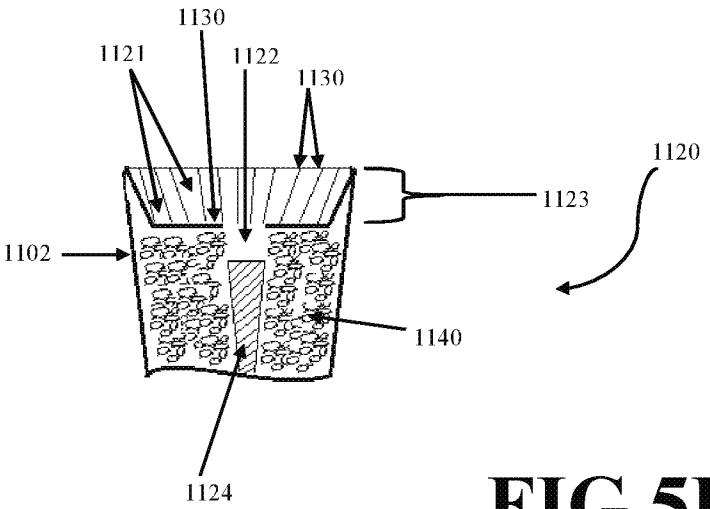
FIG. 5B is a cross-sectional side view of a distal end of an embodiment of a filled cone with a fluid core folded by an embodiment of the folder tip with an axial pin.
Figure 5A:
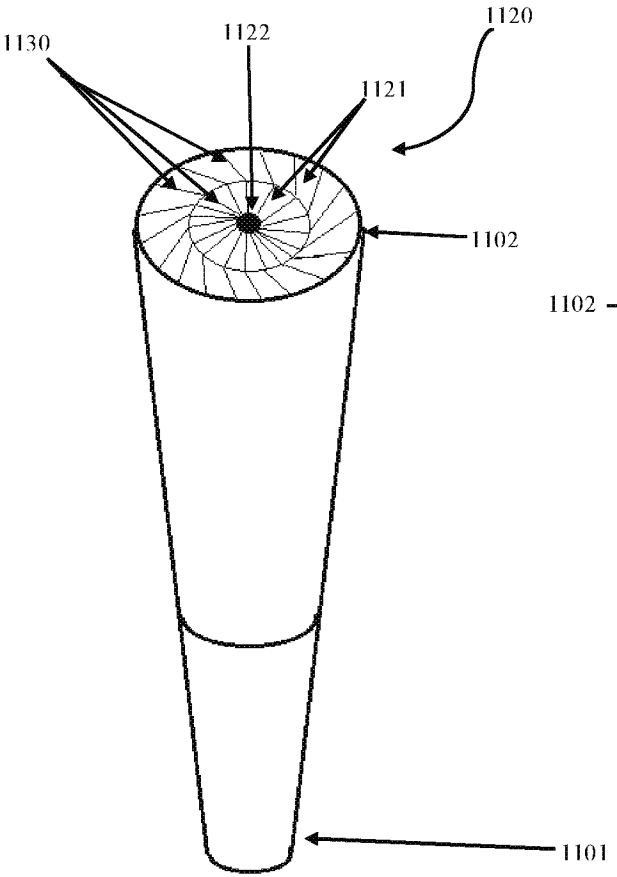
FIG. 5A is a perspective view of an embodiment of a cone folded by an embodiment of a folder tip with an axial pin.

With reference to FIGS. 4A, 4B, and 4C, there is depicted an embodiment of a folder tip 670 and with reference to FIGS. 5A and 5B there is depicted both a perspective view of a filled, folded cone and a cross-sectional view of a distal end of a filled, folded cone 1120. In one embodiment, fingers 652, 642 may come together and press the distal end of the cone against a central portion of the folding tip, such as the axial pin 671. The folding tip 670 is then pressed into the distal end of the filled cone 1120, the axial pin 671 prevents the cone from fully enclosing the distal end, and when the folding tip is retracted, an access hole 1122 is formed in the folded paper 1121 of the filled cone 1120 and thus the folded distal end extends over and substantially covers the particulate within the cone. Alternatively, the cone could be forced up into the folding tip, or a combination of movements could accomplish the same effect.

In one embodiment, the folding tip 670 includes and exterior circumferential surface 672, an interior circumferential surface 673, an axial pin 671, and a contact edge 674 as shown in FIGS. 4A-4C. Preferably the cross-section of the folding tip is circular, and preferably the diameter of the contact edge 674 is less than the largest diameter of the distal end of filled cone 1120. The exterior circumferential surface 672 of the folding tip 670 may be conical such that the angle $\alpha$ mates against the angle of the surface of a die holding the cone (for example die 310), see FIG. 3. The interior surface 673 may also be conical. In one embodiment, the angle $\beta$ of the interior surface is between 80° and 85°. The interior circumferential surface terminates at the axial pin and contact edge, respectively. During the folding process, the folding tip may be placed at the distal end of the filled cone 1120 such that a central portion, for example, the axial pin 671 is below the rim 1103 of the distal end 1102 of filled cone 1120. As the fingers 642 and 652 converge, the axial pin prevents the fingers from completely collapsing the paper of the cone, and the paper of the cone is pressed against the axial pin. The folding tip 670 is pressed toward the filled cone 1120 such that the paper of the distal end of the cone slides up the axial pin and is bounded by the interior circumferential surface 673. The contact edge 674 presses the paper of the cone into the leaves within the cone, crimping the paper of the cone in on itself (see generally, fold lines 1130 of the folded portion of the cone (1121) and into the cone while the axial pin prevents the paper of the cone from completely covering the leaves, though the majority of the distal end is covered by the folded paper. In this way, a portion of the paper of the cone is pushed into an interior cavity of the cone such that the distal end is folded in on itself and over the leaves within the cone, while a portion of the paper cone protrudes beyond the level of the leaves 1140 (and any fluid 1124 where the filled cone is injected with fluid) creating a circumferential lip 1123 around the cone. Also in this way, the end of the cone is folded and exhibits plastic deformation which thereby prevents the escape of leaves while leaving a small hole 1122 in the end of the cone. Thus, as shown in FIGS. 5A and 5B, the filled cone 1120 has a proximal end 1101 (mouth) and a distal end 1102 (tip), a circumferential lip of paper 1123, folded paper 1121 inside the circumferential lip, and an access hole 1122, approximately in the center of the folded paper 1121 such that the rim 1103 of the filled cone 1120 is folded down and in toward the center of the diameter of the cone.

In one embodiment, the length of an unfolded cone is between approximately 4 inches and 4.5 inches in length. It was found that folding the distal end of the cone such that the folded portion pressed and contacted the leaves inside the cone was better suited to ensuring that leaves within the cone did not freely pour out of the cone when the cone was inverted (particularly in folded cones having an access hole 1122) and it improved lighting the distal end of the cone as opposed to leaving an air gap between the leaves in the cone and the folded paper. Additionally, it was found that folding the cone such that the circumferential lip 1123 extended between approximately 2 mm and 5 mm produced optimal results while maximizing the interior volume of the cone that could be filled with leaves.

A number of benefits were found when folding the tip of the cone to provide the access hole 1122 in the distal end of the cone as well as creating a circumferential lip of paper 1123 as opposed to completely sealing the cone either by a full button fold or by twisting the paper of the cone closed. One benefit is that the hole provides an access point for a needle that can then be inserted into the cone to fill the cone with a fluid core without having the needle pierce through layers of cone paper. It was found that attempting to pierce through the layers of paper often displaced the leaves within the cone, or lead to uneven compacting of the leaves which detrimentally affected the burning of the cone. The hole ensures that the needle does not meet excess resistance from the paper, and is able to penetrate the length of the cone, through the leaves, without unnecessarily compacting the leaves or causing the paper to push into and displace the leaves at the tip of the cone.

Additionally, the hole allows for the creation airflow through the cone when lighting the filled cone. As a flame is brought proximate to the filled cone, air may be drawn through the cone by creating a vacuum at the small diameter end of the cone, thereby drawing the flame into the cone to contact the leaves and core. That assists in lighting the center of the cone where the fluid core may be deposited. Without the hole, when the tip is closed due to a complete fold or twisting closed of the paper, it is difficult to create a vacuum in the unlit cone. When a flame contacts a completely closed tip, it was found that the flame would light the paper, and then migrate, or run, down the side of the cone burning the paper rather than the leaves. While the leaves would eventually light, the run of flame tended to cause uneven lighting of the leaves (e.g. lighting the leaves in the vicinity of the run, rather than uniformly across the diameter of the cone) which contributed to an uneven burn rate for the filled cone. It also meant that the leaves along the outside of the cone (proximate to the paper) would ignited first, leaving the fluid filled core unlit. By adding the hole to the tip of the folded cone, when a vacuum is applied to the cone (drawing air in from the distal end and out through the proximal end), the flame is drawn directly into the center of the cone and into the fluid core, to (particularly where the fluid is a flammable oil) reliably light the core and centrally located leaves. That results in burning away of the folded paper first (before the paper of the cone surrounding and holding the leaves), which in turn helps contain the leaves as the cone burns, and it contributes to more uniform lighting and progressive burning of the leaves. It was found that providing a folding tip with the foregoing structure created more reliably uniform folds in the end of the filled cone and simultaneously provided an airflow hole in the paper cone.

Additionally, it was found that even with the access hole, leaves within the cone would not consistently uniformly light, and there was risk of flame running down the length of the cone. However, by forming the circumferential lip of paper, as the flame is drawn into the cone through the access hole, it lights the more flammable circumferential lip of paper concurrently. That is, the circumferential lip of paper provides a mass of material, more flammable than the leaves, and which mass of material surrounds the distal end of the cone such that the paper lights the circumference of the distal end and forms a strong, uniform cherry at distal end while preventing flame from running down the side of the cone.

Figure 4D:
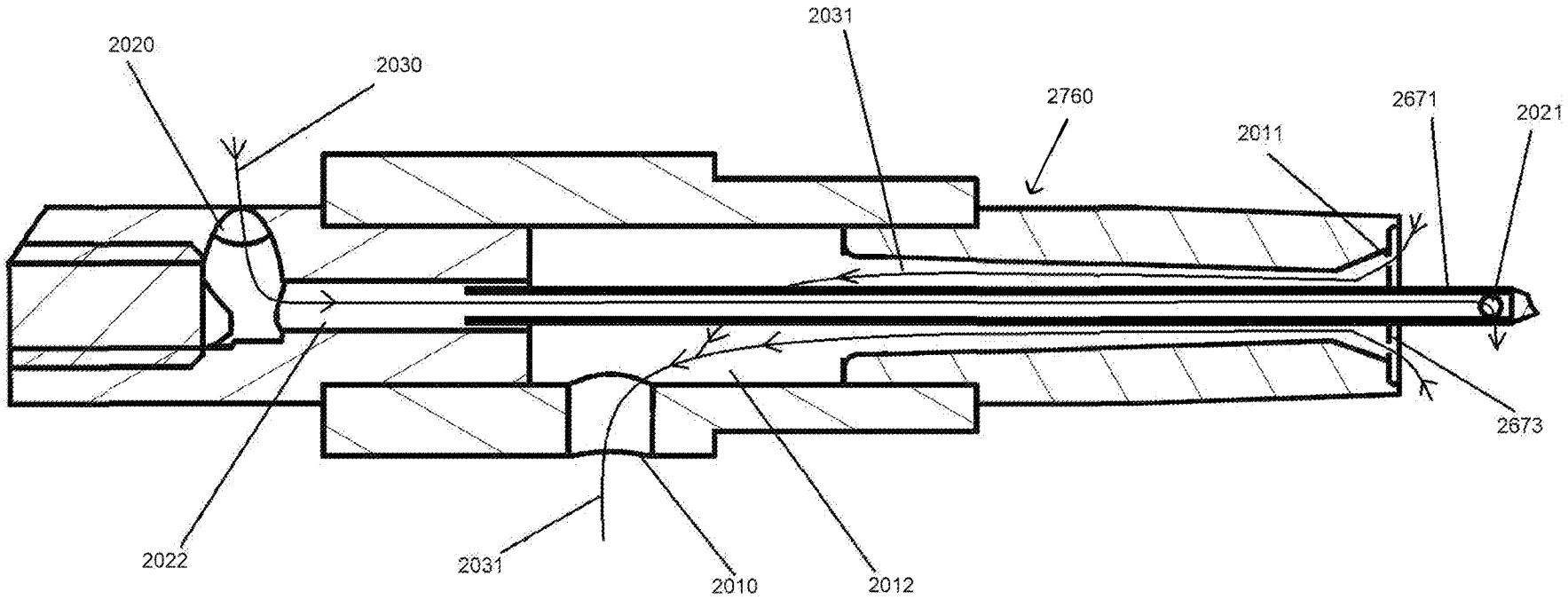
FIG. 4D is a cross-sectional view of an embodiment of a folder tip having vacuum and air pressure chambers.

A further embodiment of a folding tip incorporating an air assist folding system is shown in FIG. 4D. The interior of the folding tip is shown for explanatory purposes. FIG. 4D shows folding tip 2760 including central portion such as axial pin 2671. The folding tip includes a vacuum outlet 2010, one or more vacuum inlets 2011, an air pressure inlet 2020 and an air pressure outlet 2021. As shown in FIG. 4D, the air pressure outlet 2021 is formed at the tip of the axial pin 2671. The air pressure outlet may be formed to eject air out of the sides of the axial pin rather than straight down out of the bottom of the pin. The air pressure inlet and air pressure outlet may be connected by a chamber 2022 formed within the folding tip. Similarly, the vacuum inlets 2011 and vacuum outlet 2010 may be connected by a second, separate chamber 2012 formed in the folding tip. The one or more vacuum inlets 2011 may be formed as holes in the interior circumferential surface 2673. In one embodiment, the vacuum inlets are spaced evenly and circumferentially around the axial pin. Both the vacuum outlet and the air pressure inlet are connected to conventional pumps (not shown) suitable for applying vacuum pressure or air pressure as needed. Lines 2030 and 2031 depict the airflow paths of the air pressure and vacuum pressure, respectively. The pumps are connected to the control system which is thereby capable of operating the pumps. As shown in the figure, the hollow chamber surrounding the axial pin flares outward proximal to the interior circumferential surface. That allows for the hollow chamber to restrict airflow and create better suction near the tip while spreading out to allow for a plurality of passageways to be formed in the interior circumferential surface.

The operation of folding using air assist is generally as follows. The folding tip is lowered into the distal end of a cone such that the rim of the cone is above the contact edge 674. Folding fingers compress the distal end of the cone around the axial pin above the pressure outlet 2021. Vacuum is applied to suck air through inlets 2011, which sucks the paper of the distal end of the cone up against the folding tip and circumferential surface 2673. Concurrently, air pressure is applied through outlet 2021 which blows into the interior of the cone to at least partially inflate the cone and thereby press the paper of the cone outward. The folding fingers are retracted and the folding tip is driven into the interior of the cone, thereby folding the distal end of the cone such that distal end of the cone is folded in on itself and held by plastic deformation over at least substantially all of the particulate within the cone package.

Figure 20A:
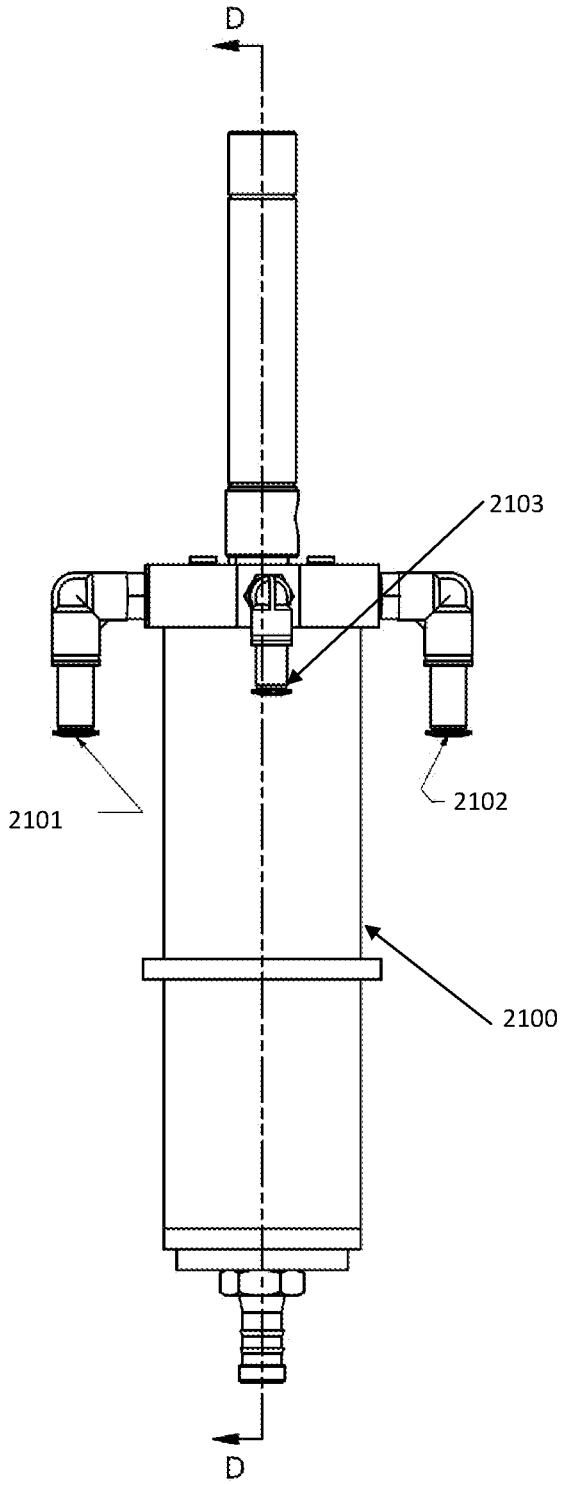
FIG. 20A is a perspective view of an embodiment of a vacuum clean out.
Figure 20B:
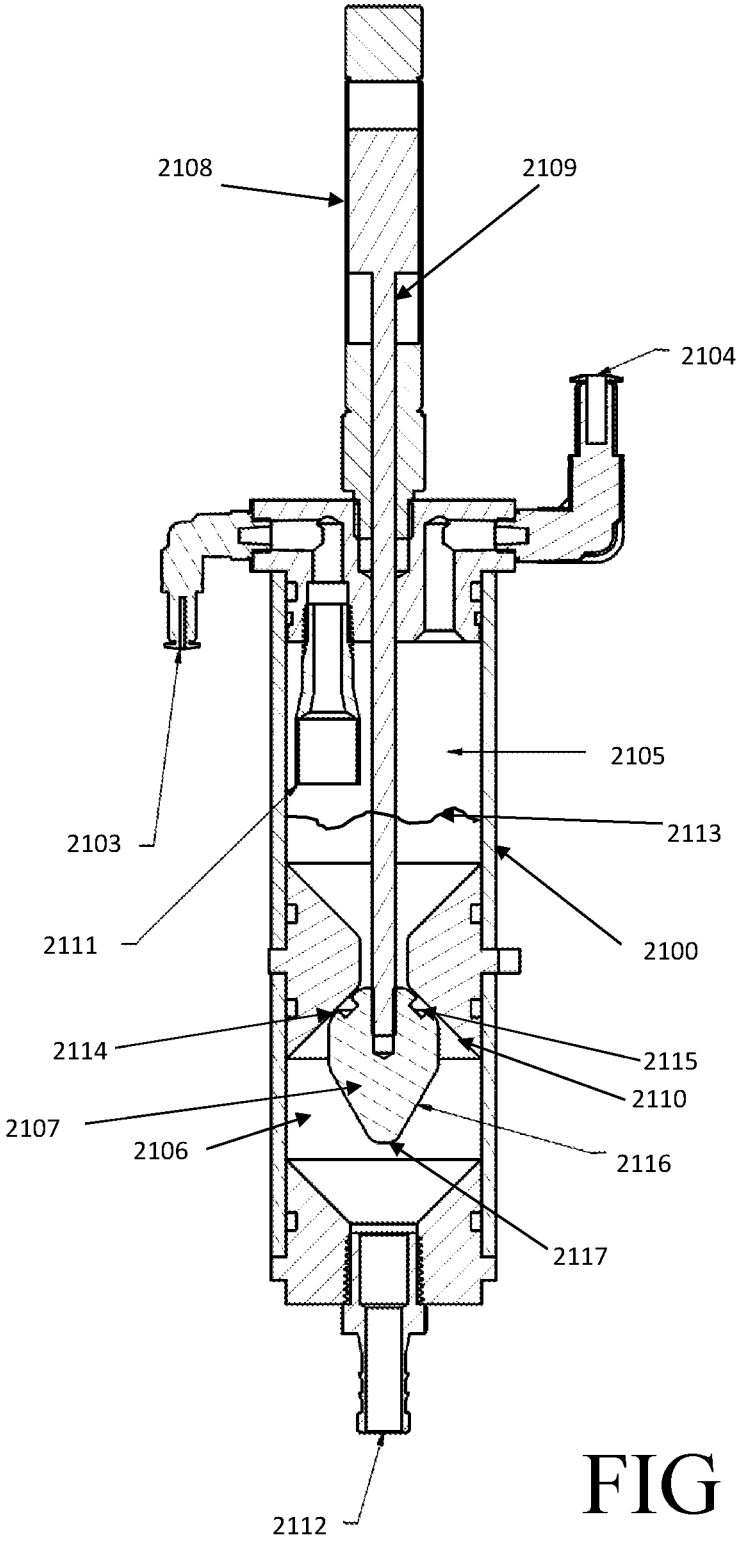
FIG. 20B is a cross-sectional view along line D of FIG. 20A of an embodiment of a vacuum clean out.

When using the air assist, it is common for the vacuum pressure to suck in small amounts of particulate from the filled cone. Over time, that can lead to large losses of particulate, or clogging of the vacuum. To prevent clogging and allow for reclaiming of the particulate, a filtration system may be included in the vacuum section of the folding section. FIGS. 20A and 20B depict an embodiment of a vacuum filtration system. It includes a housing 2100, a fluid (such as water, depicted by fluid level line 2113), fluid inlets 2101, 2102, vacuum inlet 2103, and vacuum outlet 2104, a fluid retention chamber 2105, fluid drainage chamber 2106, a movable plug 2107 separating the fluid retention chamber from the drainage chamber. The plug 2107 may be attached to an actuator 2108, for example, by rod 2109. The upper portion of the plug, 2114 is provided with an approximately 40°-50° bevel, though generally may be approximately 45°. The upper portion of the plug may be provided with a compressible o-ring, not shown, in notch 2115 that forms a fluid tight seal against chamber wall 2110. The bottom portion of the plug, 2116, is also conical, approximately 50°-60°, and comes to a rounded tip 2117. The differences in angles ensures that as fluid flows from the fluid chamber into the drainage chamber, particulate remains suspended in the fluid. However, the steeper angle on the lower plug allows for a different flow rate of fluid and assists in cleaning particulate off of the plug. The vacuum inlet is connected to a vacuum diffuser 2111 that has an outlet positioned above the fluid level. As vacuum is applied to the folding tip, particulate may be sucked up, travel through the vacuum diffuser and be ejected into the fluid which traps the particulate. The plug may be actuated periodically to release fluid and clear away buildup of particulate in the fluid. The released fluid may then pass out the drain 2112 to a reclamation filter (not shown), the structure of which is known in the art.

Figure 6A:
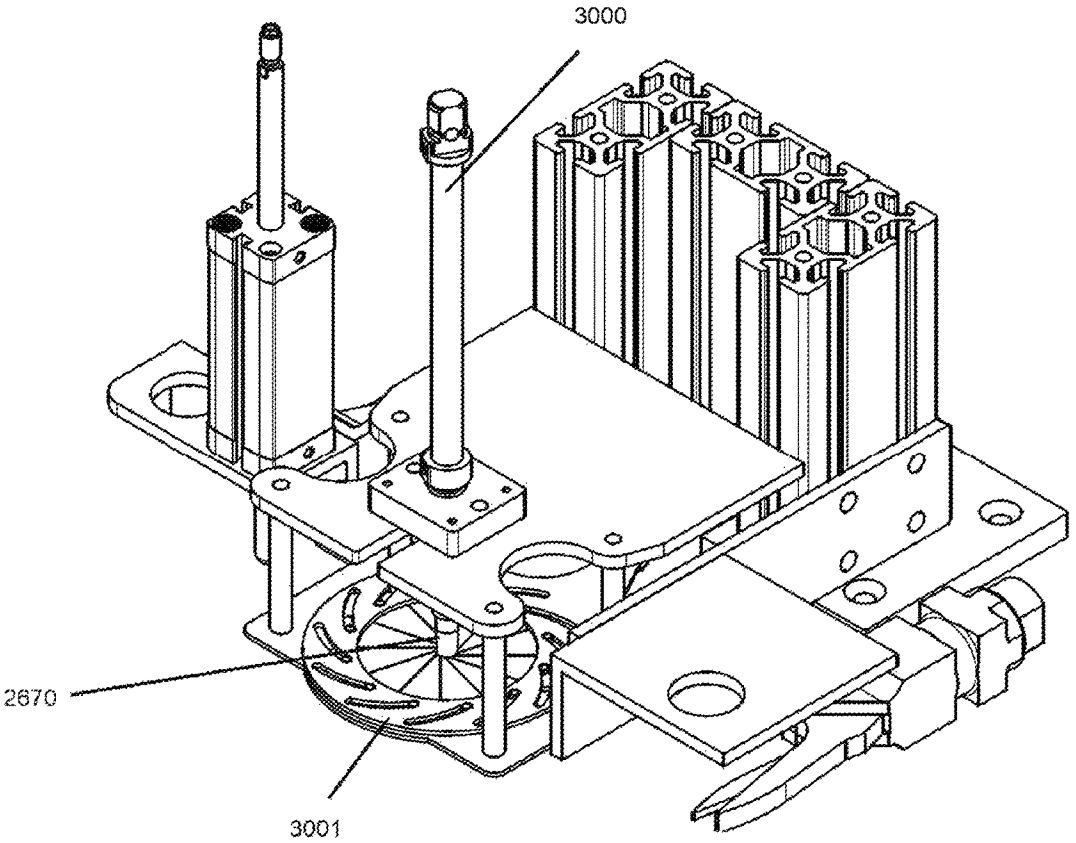
FIG. 6A is a perspective view of an iris folding station subassembly.
Figure 6B:
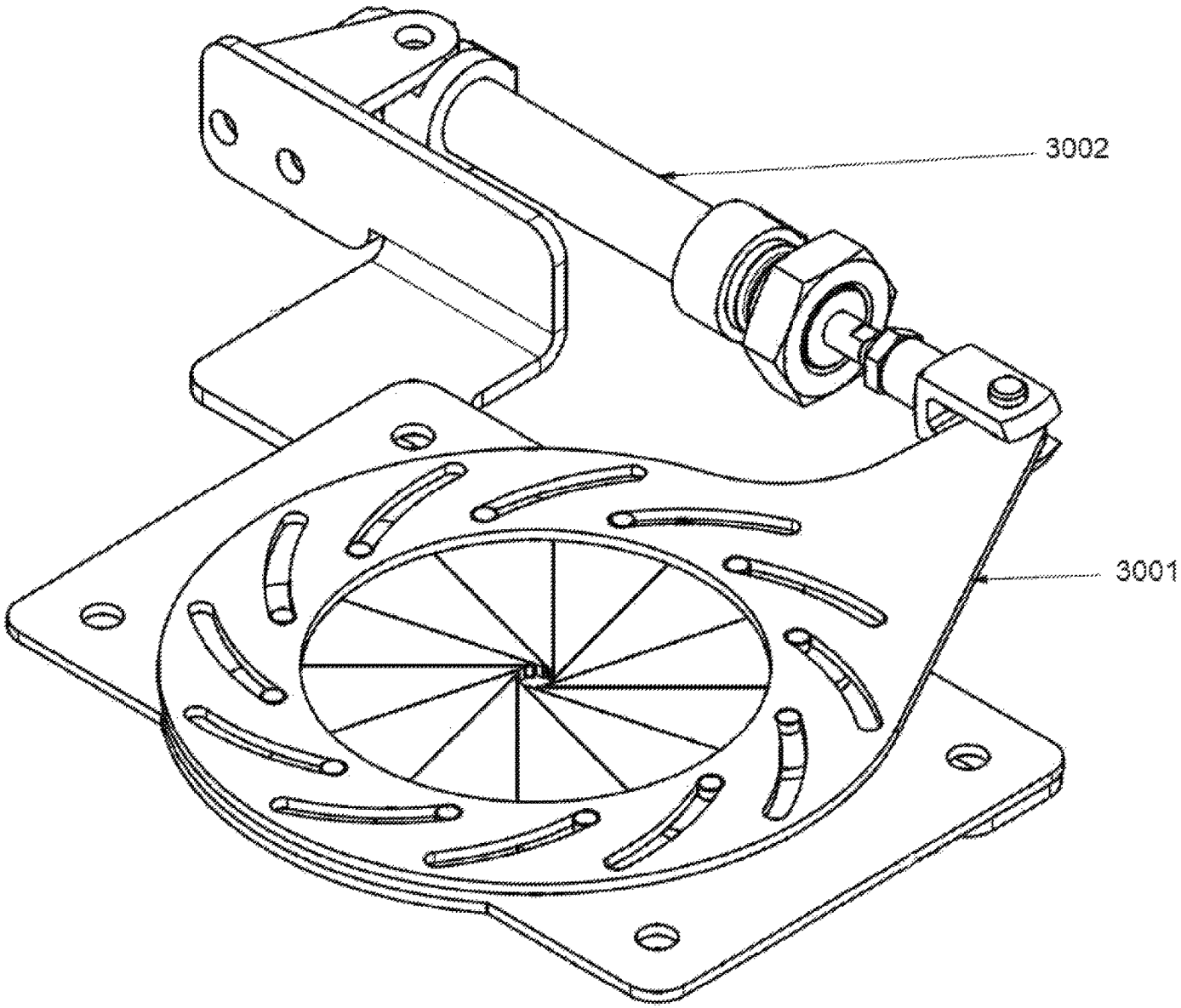
FIG. 6B is a perspective view of an iris portion of the iris station subassembly.
Figure 7A:
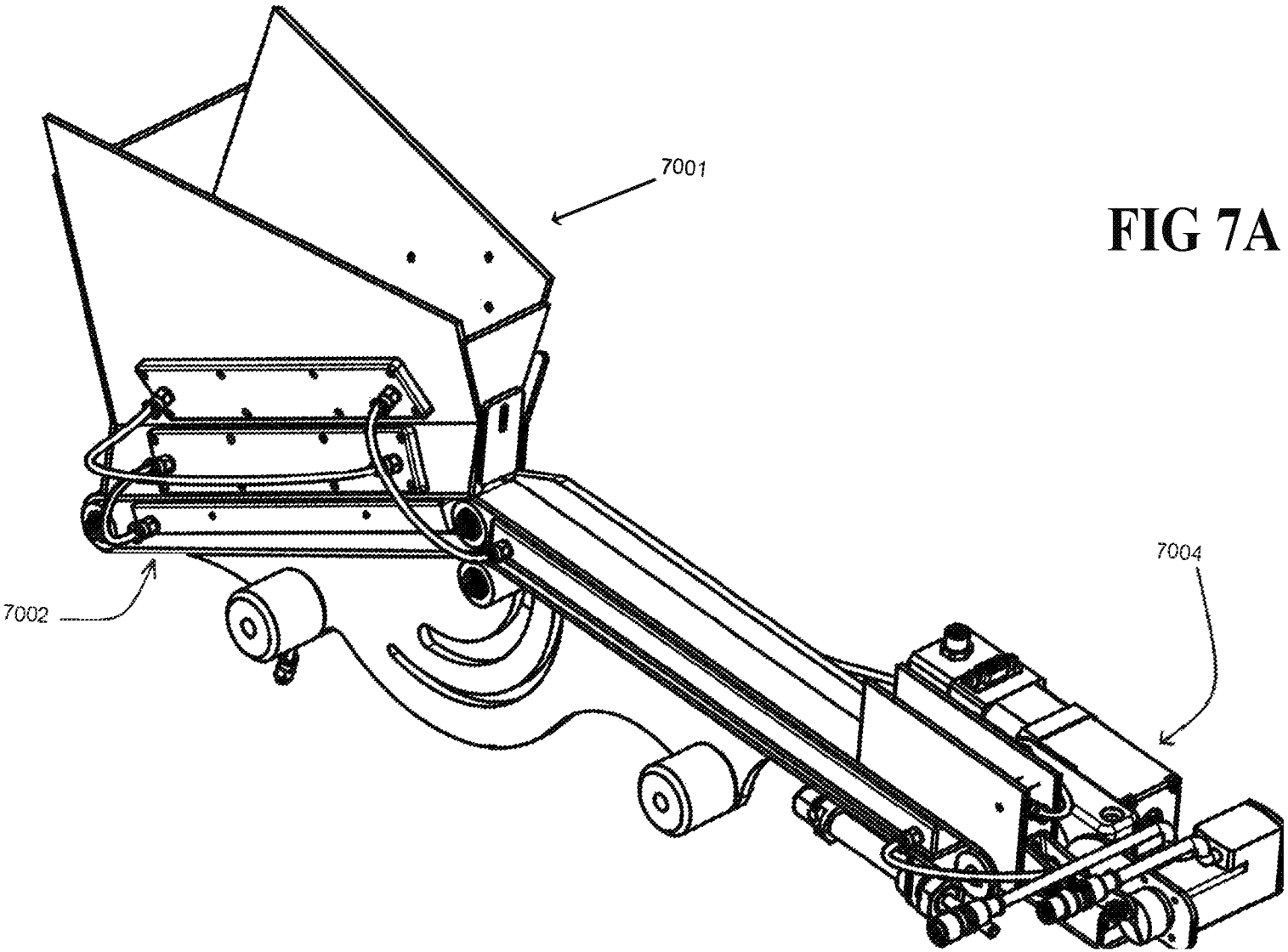
FIG. 7A is a perspective view of an embodiment of a hopper, conveyor and feeder assembly.
Figure 7B:
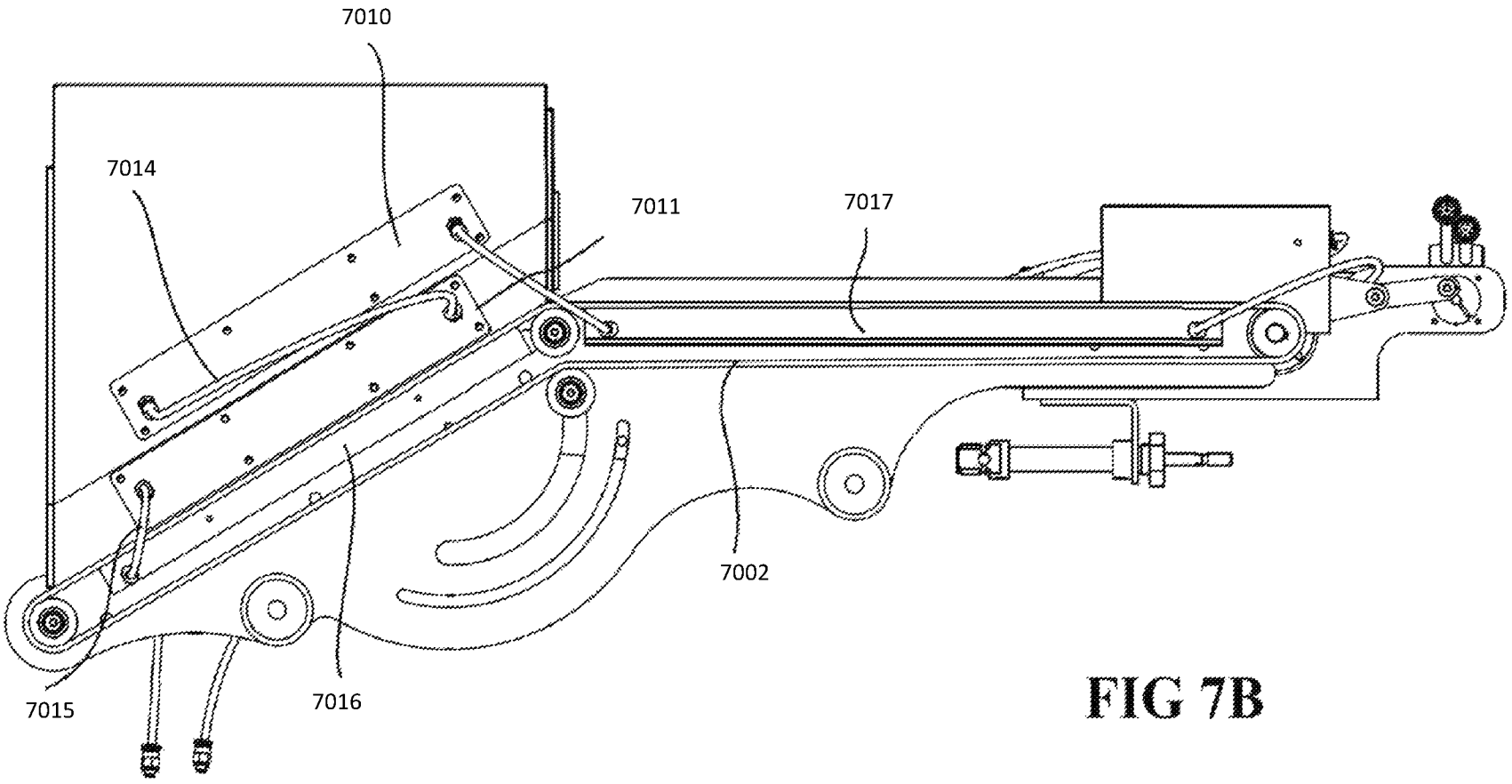
FIG. 7B is a side view of an embodiment of a hopper, conveyor and feeder assembly.
Figure 8B:
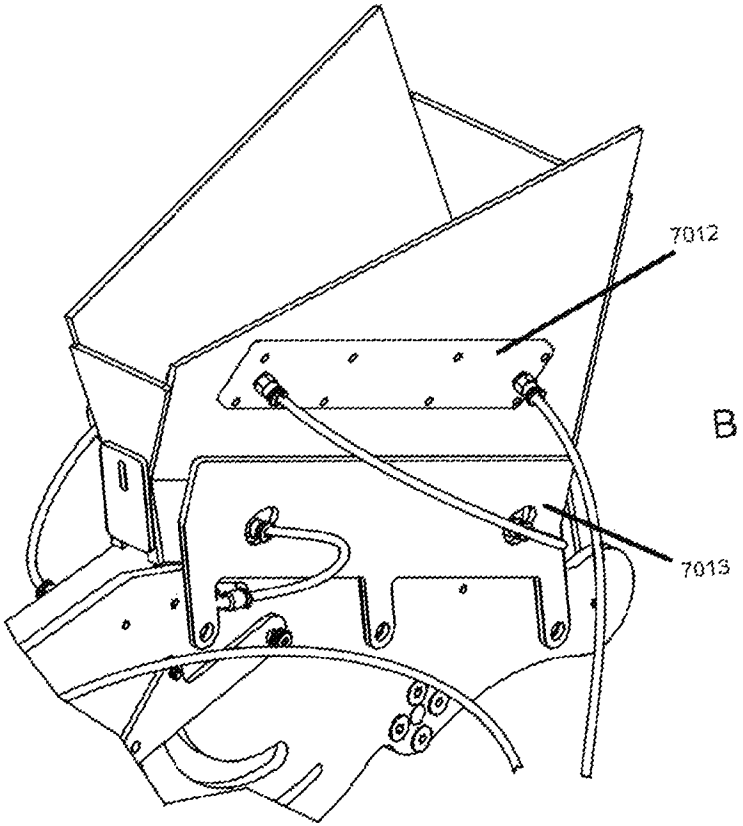
FIG. 8B is an enlarged view of an embodiment of a hopper.
Figure 8A:
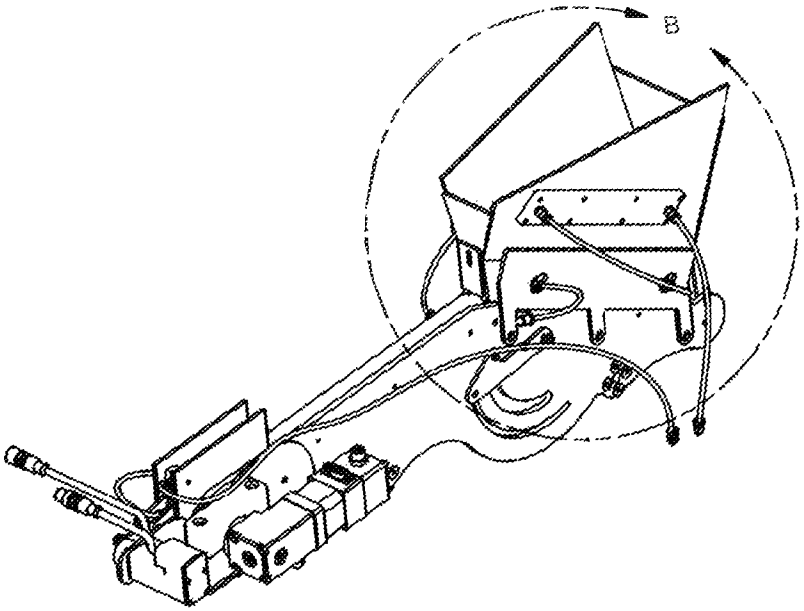
FIG. 8A is a perspective view of an embodiment of a hopper, conveyor and feeder assembly and including an indication of the portion of the assembly enlarged in FIG. 8B.
Figure 9B:
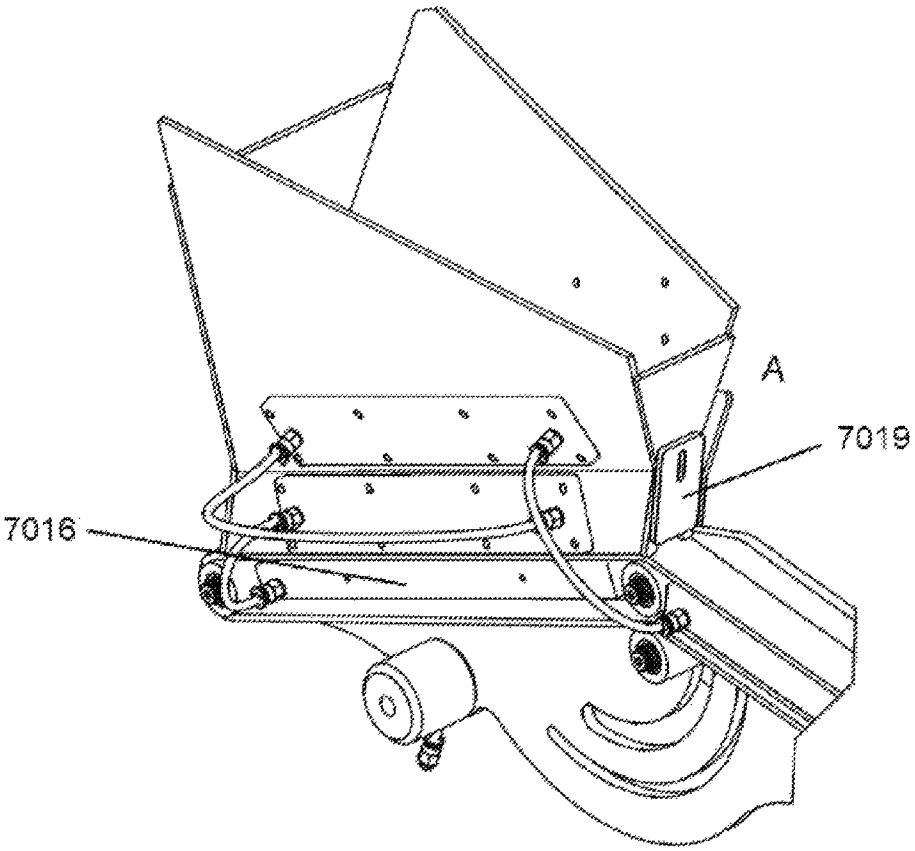
FIG. 9B is an enlarged view of an embodiment of a hopper.
Figure 9A:
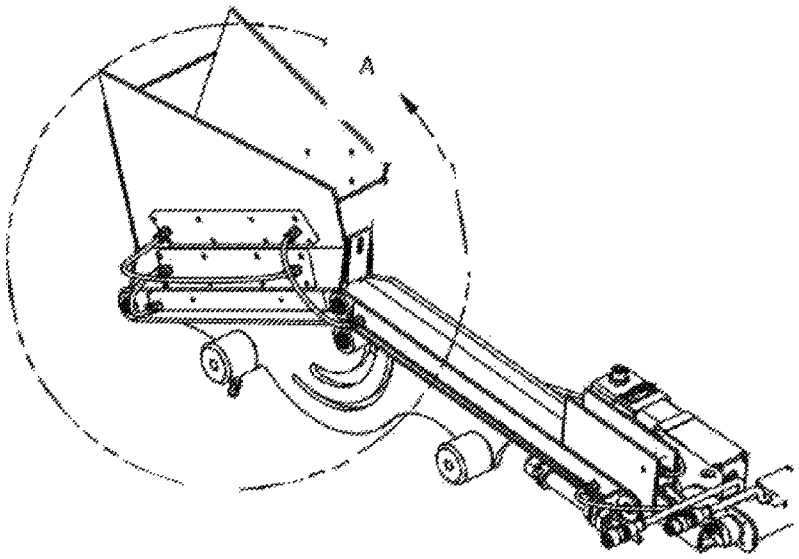
FIG. 9A is a perspective view of an embodiment of a hopper, conveyor and feeder assembly and including an indication of the portion of the assembly enlarged in FIG. 9B.
Figure 10B:
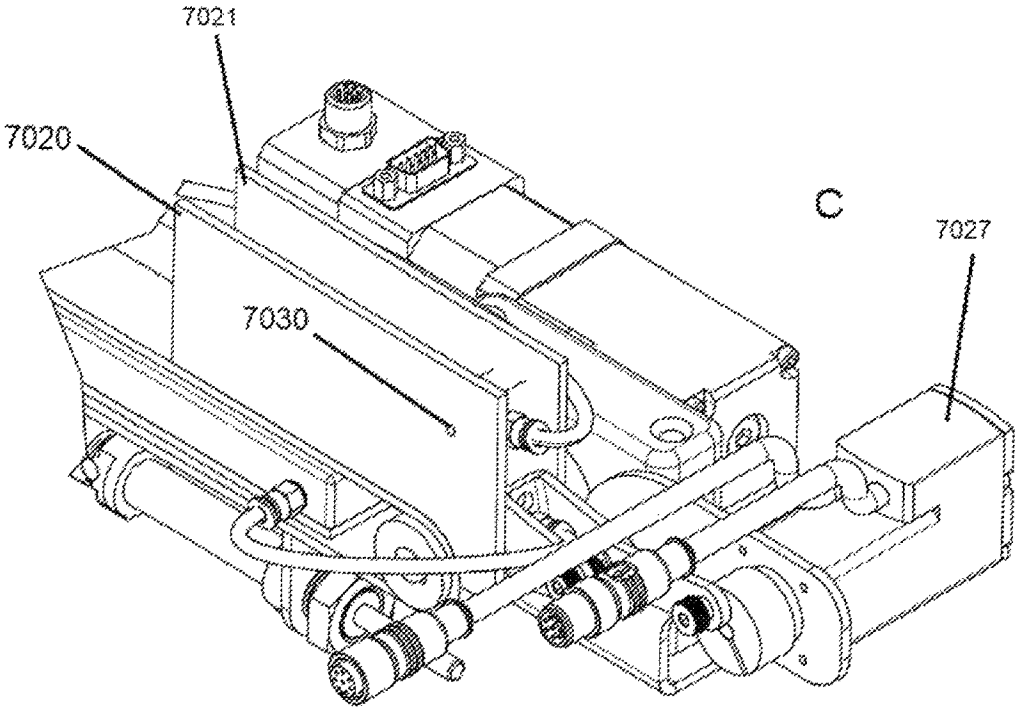
FIG. 10B is an enlarged view of an embodiment of a feeder assembly.
Figure 10A:
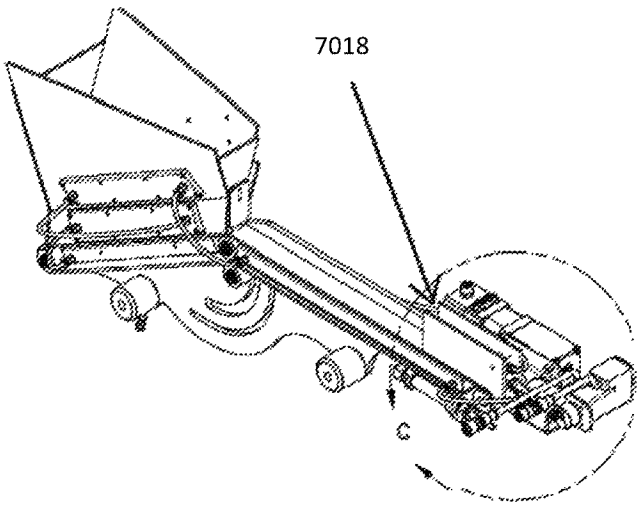
FIG. 10A is a perspective view of an embodiment of a hopper, conveyor and feeder assembly and including an indication of the portion of the assembly enlarged in FIG. 10B.

In one embodiment, the folding tip may be utilized in conjunction with folding fingers 652 and 642. An alternate embodiment utilizes an iris to apply closing pressure against the distal end of a cone. FIGS. 6A-6B depict a folding station sub assembly utilizing an iris 3001 and the components thereof. The folding station includes a folding rod 3000, an iris 3001, and an iris actuator 3002 that opens and closes the iris. The folding rod terminates in a folding tip, for example, folding tip 2670. The iris, folding rod, folding tip, vacuum and air pressure work in conjunction to fold the distal end of a cone.

One method of folding a cone is as follows. A die 310 containing a filled, unfolded cone is axially aligned with the folding tip 2670. The relative vertical position of the cone with respect to the iris is adjusted such that the iris is below the rim 1103 of the distal end 1102 of the cone. The folding tip 2670 is positioned such that at least a portion of the axial pin 2671 is below the rim 1103 of the distal end 1102 of filled cone 1120 (that is, a central portion of the tip is positioned within the interior cavity of the cone). The iris actuator actuates to close the iris, and thereby compress the distal end of the cone toward the central axis of the cone and may further compress the distal end against the axial pin. It should be appreciated that the movement and positioning of the cone and the axial pin with respect to the cone and the closing of the iris to compress the cone may occur as discrete steps or may occur simultaneously.

Once the distal end of the cone is compressed, for example, compressed against the axial pin, the vacuum is applied to the folding tip. The vacuum sucks the distal end of the cone against the circumferential interior surface 2673 of the folding tip, next (or simultaneously), the air pressure pump is activated to apply air pressure through the axial pin to the interior cavity of the cone. With the axial pin inserted into the distal end of the cone, the air pressure outlet is within the interior of the cone when the cone is being pressed against the axial pin by the iris and when the cone is being vacuumed against the interior circumferential surface. The air pressure may be applied to inflate the cone and further press the exterior of the cone against the die. It was found that the combination of the application of vacuum pressure in conjunction with interior air pressure stiffened the paper of the distal end of the cone. With the cone stiffened, the folding tip is forced down and into the distal end of the cone and the vacuum and air pressure are ceased. In practice, the iris may open just as the vacuum and air pressure are applied, and the folding tip may be forced into the cavity as the iris opens or shortly thereafter. The folding tip is then withdrawn from the cone and the distal end of the cone is left folded and exhibits plastic deformation.

With reference to FIGS. 14, 15, 16A and 16B, an alternate embodiment of the folding station utilizes one or more sets of folding fingers as shown. In that embodiment, the sets of fingers 1410, 1420, are positioned below the folding tip 670. In one embodiment, the folding fingers are offset from each other both vertically, and angularly. Thus, one set of fingers closes around the distal end of a cone and around a portion of the folding tip at a first angle and in an upper vertical position, and the second set closes similarly, though at a lower vertical position and at a second angle, for example at an angle offset from the first angle between 45° and 90°.

Figure 15:
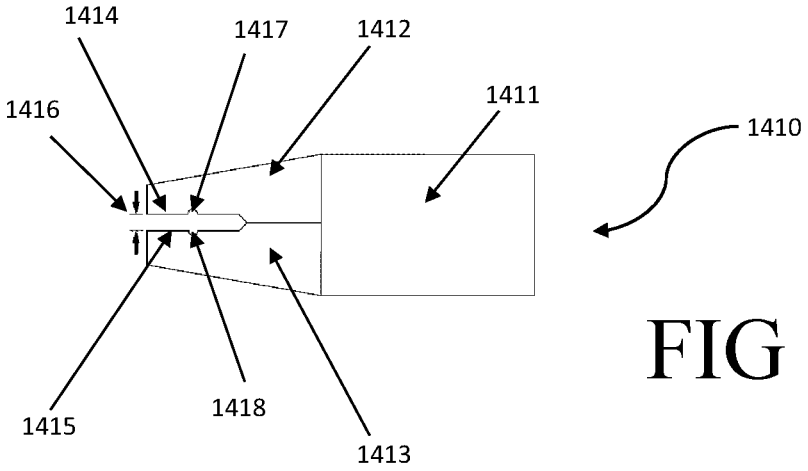
FIG. 15 is an exaggerated plan view of an embodiment of the folding fingers.
Figure 16A:
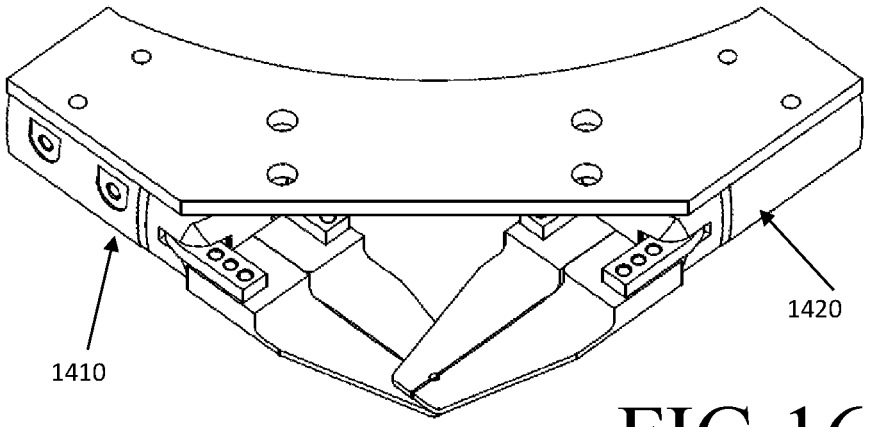
FIG. 16A is a perspective view of an embodiment of the folding fingers arranged at an approximately 90° angle and in closed positions.
Figure 16B:
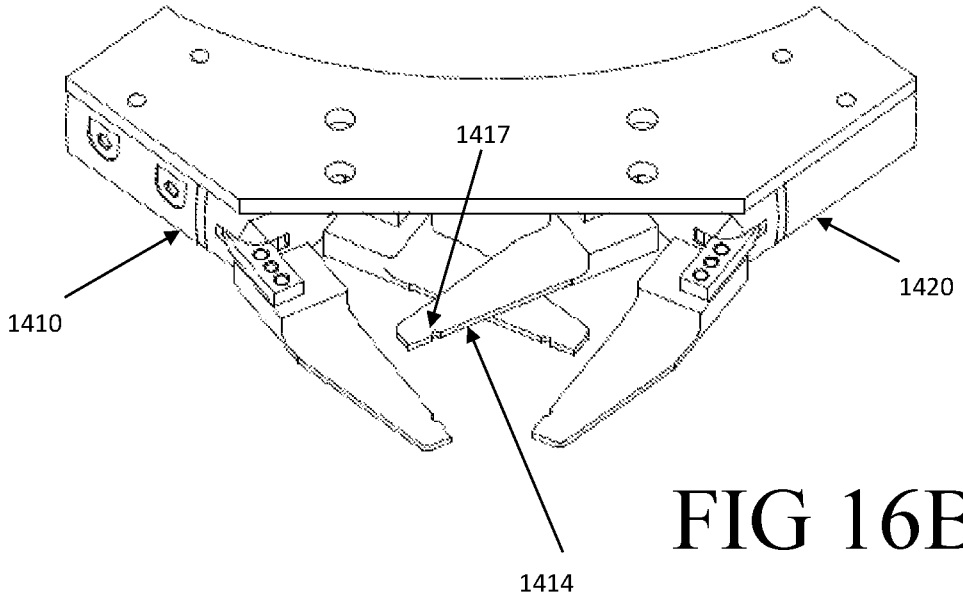
FIG. 16B is a perspective view of an embodiment of the folding fingers arranged at an approximately 90° angle and in open positions.

FIG. 15 is an exaggerated block drawing of an example of a set of folding fingers 1410. The fingers include actuator 1411 that causes the fingers 1412, 1413 to open and close in a scissor actuation simultaneously. Each finger may include a recess 1414, 1415 along a portion of its interior blade length. The recess forms a gap 1416 between portions of the interior blade lengths of the fingers when the fingers are in the closed position. The back portion of the blade lengths may be allowed to come together completely to form a stop. It was found that when the distal end of a paper cone was compressed by folding fingers without the gap, the friction created by the tight pinch made it difficult to accurately fold the distal end, and could lead to ripping of the cone as the cone was drawn through the fingers. The gap allows the suction of the tip to more easily manipulate the distal end of the paper and draw the distal end to the folding tip while maintaining proper positioning and crimping of the distal end by the folding fingers. The folding fingers each may also include an indentation 1417, 1418. In one embodiment, each indentation is approximately a semicircle such that each mates with the exterior surface of axial pin 671. As shown in FIGS. 16A and 16B, the fingers open and close at different vertical heights in substantially parallel planes.

Figure 21:
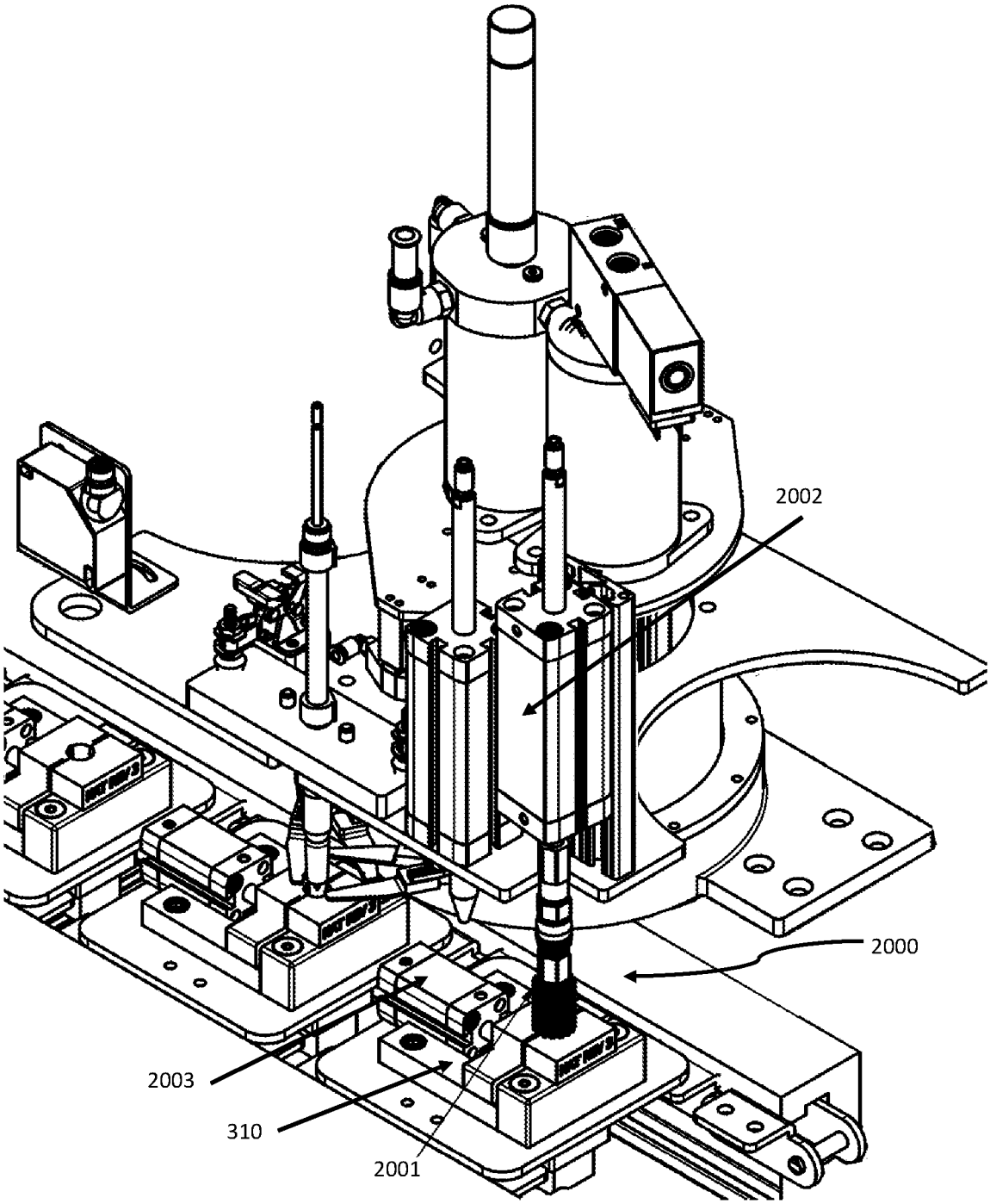
FIG. 21 is a perspective view of an embodiment of a cone die and cleaning brush.

FIG. 21 is a depiction of a die clean out station. After filling and folding a cone, the die 310 releases the filled cone. The die may then progress to a die clean out station 2000 where a brush 2001 connected to an actuator 2002 is used to clean out any remnant particulate from the die. The die actuator 2003 may close the die, and brush actuator 2002 may plunge the brush into the die. In some embodiment the actuator may also spin the brush to further clean the interior of the die. The brush may then be extracted from the die and the die may be recycled through the machine to assist in filling another cone.

Although the present invention has been described in terms of various embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

What is claimed is:

1. A fluid injection apparatus comprising:

a reservoir, a positive flow path, a negative flow path, a needle having a shaft hole formed therein, a needle actuator, a chamber, a positive pump, and a negative pump, the reservoir includes an outlet proximal to the bottom and an inlet formed in an upper portion;

the positive flow path extends from the outlet of the reservoir to the shaft hole of the needle and the positive pump is adapted to flow fluid from the reservoir, through the positive flow path and to the shaft hole;

the negative flow path extends away from the shaft hole to the inlet of the reservoir and the negative pump is adapted to flow fluid away from the shaft hole and to the reservoir;

the chamber separates and connects the positive flow path and the negative flow path the needle further comprises a tip and a needle pathway connecting the needle hole and the tip;

the needle actuator is adapted to reciprocate the needle within the chamber.

2. The fluid injection apparatus as in claim 1 wherein the positive pump is adapted to apply positive pressure to the positive flow path to flow fluid through the needle pathway and out of the tip, and the negative pump is adapted to flow fluid out of the needle hole, through the negative flow path and into the reservoir such that fluid only flows one direction in the positive flow path and one direction in the negative flow path.

3. The fluid injection apparatus as in claim 1 further comprising a heater surrounding a portion of the needle.

4. The fluid injection apparatus as in claim 1 further comprising one or more heating elements adapted to heat the fluid in the reservoir and the positive fluid pathway.

5. The fluid injection apparatus as in claim 1 further comprising a fluid within the reservoir that has undergone a decarboxylation process prior to being pumped by the positive pump.

6. The fluid apparatus as in claim 3 wherein the heater surrounds a majority of the length of the needle.

* * * * *